US011015394B2

(12) United States Patent
Casad et al.

(10) Patent No.: US 11,015,394 B2
(45) Date of Patent: May 25, 2021

(54) DOWNHOLE TOOL WITH FIXED CUTTERS FOR REMOVING ROCK

(71) Applicant: Ulterra Drilling Technologies, L.P., Fort Worth, TX (US)

(72) Inventors: Christopher M. Casad, Benbrook, TX (US); Carl Aron Deen, Fort Worth, TX (US)

(73) Assignee: Ulterra Drilling Technologies, LP, Fort Worth, TX (US)

( * ) Notice: Subject to any disclaimer, the term of this patent is extended or adjusted under 35 U.S.C. 154(b) by 189 days.

(21) Appl. No.: 16/104,854

(22) Filed: Aug. 17, 2018

(65) Prior Publication Data

US 2019/0136635 A1 May 9, 2019

Related U.S. Application Data

(63) Continuation-in-part of application No. 14/742,339, filed on Jun. 17, 2015, now Pat. No. 10,233,696.

(60) Provisional application No. 62/715,771, filed on Aug. 7, 2018, provisional application No. 62/719,097, filed on Aug. 16, 2018, provisional application No. 62/013,802, filed on Jun. 18, 2014.

(51) Int. Cl.

| | |
|---|---|
| ***E21B 10/42*** | (2006.01) |
| ***E21B 10/02*** | (2006.01) |
| ***E21B 10/60*** | (2006.01) |
| *E21B 10/55* | (2006.01) |

(52) U.S. Cl.

CPC ..... *E21B 10/42* (2013.01); *E21B 10/02* (2013.01); *E21B 10/602* (2013.01); *E21B 10/55* (2013.01)

(58) Field of Classification Search

CPC ..... E21B 10/02; E21B 10/42; E21B 10/43; E21B 10/55; E21B 10/602

See application file for complete search history.

(56) References Cited

U.S. PATENT DOCUMENTS

| | | | |
|---|---|---|---|
| 1,923,488 | A | 8/1933 | Howard et al. |
| 2,304,482 | A | 12/1942 | Aaron |
| 2,783,973 | A | 3/1957 | Hawthorne et al. |
| 3,180,440 | A | 4/1965 | Bridwell |

(Continued)

FOREIGN PATENT DOCUMENTS

| | | |
|---|---|---|
| CA | 2274152 | 6/1998 |
| CA | 2966845 | 7/2016 |
| SU | 378618 | 4/1973 |

OTHER PUBLICATIONS

Ulterra, "The Cutting Conundrum: SplitBlade Enhances Cuttings Evacuation and Improves Efficiency", Discovery Call, Available online at https://ulterra.com/pdc-bit/the-cuttings-conundrum/, accessed from internet on Aug. 21, 2019, 11 pages.

(Continued)

*Primary Examiner* — Christopher J Sebesta

(74) *Attorney, Agent, or Firm* — Kilpatrick Townsend & Stockton LLP

(57) ABSTRACT

A drag bit includes a blade extending from the bit body and supporting inner cutters proximate the longitudinal axis and outer cutters spaced from the longitudinal axis. The inner cutters are rotationally offset from the outer cutters. During operation the inner cutters deposit cut material in a channel that is contiguous with a channel that receives material cut by the outer cutters. The cutters and the contiguous channels flush agglomerating material from the slots.

23 Claims, 19 Drawing Sheets

(56) References Cited

U.S. PATENT DOCUMENTS

| | | | | |
|---|---|---|---|---|
| 3,251,425 | A | 5/1966 | Bridwell et al. | |
| 4,848,489 | A * | 7/1989 | Deane | E21B 10/43 175/429 |
| 4,981,183 | A | 1/1991 | Tibbitts | |
| 5,103,922 | A | 4/1992 | Jones | |
| 5,460,230 | A | 10/1995 | Dekoster | |
| 5,568,838 | A | 10/1996 | Struthers et al. | |
| 6,006,844 | A | 12/1999 | Van Puymbroeck et al. | |
| 6,062,235 | A | 5/2000 | Renna | |
| 7,055,626 | B2 | 6/2006 | Wells et al. | |
| 7,703,557 | B2 | 4/2010 | Durairajan et al. | |
| 7,762,355 | B2 | 7/2010 | Mcclain et al. | |
| 8,418,785 | B2 * | 4/2013 | Azar | E21B 10/43 175/430 |
| 8,439,136 | B2 | 5/2013 | Jones et al. | |
| 9,115,552 | B2 | 8/2015 | Chen | |
| 9,366,090 | B2 | 6/2016 | Azar et al. | |
| 9,371,699 | B2 | 6/2016 | Richert et al. | |
| 9,598,911 | B2 | 3/2017 | Uhlenberg et al. | |
| 9,702,196 | B2 | 7/2017 | Adams | |
| 9,752,387 | B2 | 9/2017 | Richert et al. | |
| 10,125,553 | B2 | 11/2018 | Uhlenberg et al. | |
| 10,233,696 | B2 | 3/2019 | Casad | |
| 10,329,843 | B2 | 6/2019 | Reboul et al. | |
| 10,731,421 | B2 | 8/2020 | Casad | |
| 2003/0173116 | A1 | 9/2003 | Wells et al. | |
| 2009/0084606 | A1 * | 4/2009 | Doster | E21B 10/42 175/327 |
| 2010/0252332 | A1 | 10/2010 | Jones et al. | |
| 2011/0127087 | A1 * | 6/2011 | Hareland | E21B 10/602 175/393 |
| 2011/0226533 | A1 | 9/2011 | Adams | |
| 2011/0266071 | A1 * | 11/2011 | Lind | E21B 10/55 175/428 |
| 2012/0152624 | A1 | 6/2012 | Chen | |
| 2013/0112485 | A1 | 5/2013 | Richert et al. | |
| 2015/0233185 | A1 * | 8/2015 | Maouche | E21B 10/5673 175/431 |
| 2015/0275473 | A1 * | 10/2015 | Van Opstal | E02F 5/282 37/343 |
| 2015/0322722 | A1 | 11/2015 | Uhlenberg et al. | |
| 2015/0368976 | A1 | 12/2015 | Langford et al. | |
| 2015/0368979 | A1 | 12/2015 | Casad | |
| 2016/0177629 | A1 | 6/2016 | Azar | |
| 2016/0258223 | A1 | 9/2016 | Uhlenberg et al. | |
| 2016/0281439 | A1 | 9/2016 | Richert et al. | |
| 2017/0328180 | A1 | 11/2017 | Da Silva et al. | |
| 2018/0266182 | A1 | 9/2018 | Fraser et al. | |
| 2019/0136635 | A1 | 5/2019 | Casad et al. | |

OTHER PUBLICATIONS

U.S. Appl. No. 15/999,039, "Non-Final Office Action", dated Aug. 21, 2019, 10 pages.

International Application No. PCT/US2019/045525, "International Search Report and Written Opinion", dated Oct. 16, 2019, 10 pages.

"Ridge", Retrieved From https://www.thefreedictionary.com/ridge, 2018, 6 pages.

U.S. Appl. No. 14/742,339, "Final Office Action", dated Jun. 18, 2018, 24 pages.

U.S. Appl. No. 14/742,339, "Notice of Allowance", dated Nov. 7, 2018, 15 pages.

Varhaug, "Bits", The Defining Series, www.slb.com/defining, 2016, 2 pages.

U.S. Appl. No. 15/999,039, Final Office Action, dated Feb. 26, 2020, 7 pages.

U.S. Appl. No. 15/999,039, Notice of Allowance, dated May 22, 2020, 5 pages.

U.S. Appl. No. 16/265,448, Final Office Action, dated Jun. 8, 2020, 10 pages.

U.S. Appl. No. 16/265,448, Non-Final Office Action, dated Feb. 3, 2020, 15 pages.

U.S. Appl. No. 16/265,448, Notice of Allowance, dated Oct. 15, 2020, 8 pages.

* cited by examiner

DOWNHOLE TOOL WITH FIXED CUTTERS FOR REMOVING ROCK

TECHNICAL FIELD OF THE INVENTION

This invention is related in general to the field of downhole tools with fixed cutters for removing rock. More particularly, the invention is related to rotary drag bits with blades supporting cutters.

BACKGROUND OF THE INVENTION

In a typical drilling operation, a drill bit is rotated while being advanced into a rock formation. There are several types of drill bits, including roller cone bits, hammer bits and drag bits. There are many drag bit configurations of bit bodies, blades and cutters.

Drag bits typically include a body with a plurality of blades extending from the body. The bit can be made of steel alloy, a tungsten matrix or other material. Drag bits typically have no moving parts and are cast or milled as a single-piece body with cutting elements brazed into the blades of the body. Each blade supports a plurality of discrete cutters that contact, shear and/or crush the rock formation in the borehole as the bit rotates to advance the borehole. Cutters on the shoulder of drag bits effectively enlarge the borehole initiated by cutters on the nose and in the cone, or center, of the drill bit.

FIG. 1 is a schematic representation of a drilling operation 2. In conventional drilling operations a drill bit 10 is mounted on the end of a drill string 6 comprising drill pipe and drill collars. The drill string may be several miles long and the bit is rotated in the borehole 4 either by a motor proximate to the bit or by rotating the drill string or both simultaneously. A pump 8 circulates drilling fluid through the drill pipe and out of the drill bit flushing rock cuttings from the bit and transporting them back up the borehole. The drill string comprises sections of pipe that are threaded together at their ends to create a pipe of sufficient length to reach the bottom of the borehole 4.

Cutters mounted on blades of the drag bit can be made from any durable material, but are conventionally formed from a tungsten carbide backing piece, or substrate, with a front facing table comprised of a diamond material. The tungsten carbide substrates are formed of cemented tungsten carbide comprised of tungsten carbide particles dispersed in a cobalt binder matrix. The diamond table, which engages the rock formation, typically comprises polycrystalline diamond ("PCD") directly bonded to the tungsten carbide substrate, but could be any hard material. The PCD table provides improved wear resistance, as compared to the softer, tougher tungsten carbide substrate that supports the diamond during drilling.

Cutters shearing the rock in the borehole are typically received in recesses along the leading edges of the blades. The drill string and the bit rotate about a longitudinal axis and the cutters mounted on the blades sweep a radial path in the borehole, failing rock. The failed material passes into channels between the bit blades and is flushed to the surface by drilling fluid pumped down the drill string.

Some materials the bit passes through tend to clog the channels and reduce the efficiency of the bit in advancing the borehole. As the bit fails materials such as shale at the borewall, the material quickly absorbs fluid and can form clays that are sticky. Clays can form ribbons as it is cut from the bore that agglomerate and can cling to the surface of the bit in the channels. This narrows the channels and can inhibit flushing of new material to the surface. The material expands as it absorbs water and pressure increases in the channels of the bit. While this pressure in the channel can help flush less sticky material from the channel, the pressure can cause clay to stick to the channel walls. This causes the bit to bog down and limits the volume of new material that can be processed through the channel.

Bits configured to advance boreholes through materials of finer consistency that form clays and flush the failed materials more efficiently out of channels without clogging can be advantageous.

SUMMARY

The present invention pertains to drilling operations where a rotating bit with cutters advances a borehole in the earth. The bit is attached to the end of a drill string and is rotated to fail the rock in the borehole. Cutters on blades of a bit contact the formation and fail the rock of the borehole by shearing or crushing. Described below are representative examples of several embodiments implementing improvements to blade and channel geometries and features capable for improving rates of penetration of rotary bits. Some of the improvements concern channels that better process or evacuate material cut from the borehole by the cutters. The channels function to remove and flush materials such as ribbons of clay materials that can agglomerate and stick to the surface of the channel. When the material sticks in the channel, the channel is significantly narrowed and becomes clogged. Inefficient removal of these clay-like materials can limit the rate of penetration as new material cannot readily pass through the channels clogged by earlier materials.

Other of the improvements concern blade geometries that allow for greater rates of penetration and improved evacuation of cuttings.

The different features of the various embodiments of the bits described below are usable independently or in combination with the features of other embodiments. Other aspects, advantages, and features of the representative, non-limiting examples of the bits described below will be recognizable.

DETAILED DESCRIPTION

Figure 1:
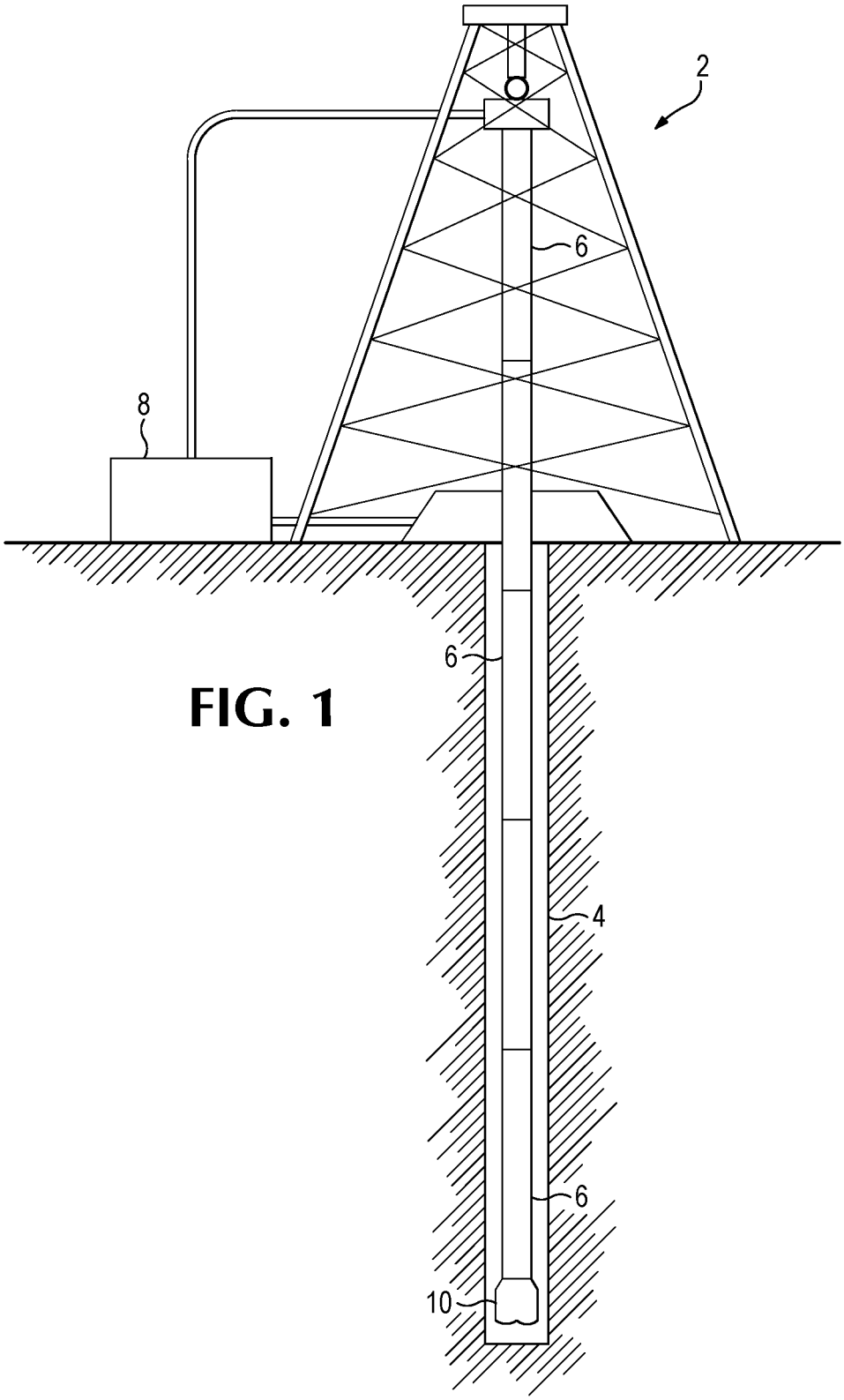
FIG. 1 is a schematic depiction of a drilling system according to an exemplary embodiment of the present invention.

Bits used in downhole boring operations such as for gas and oil exploration operate at extreme conditions of heat and pressure often miles underground. The rate of penetration of the bit in creating the borehole is one factor to producing a cost effective drilling operation. The rate of penetration depends on several factors including the density of the rock the borehole passes through, the configuration of the bit and the weight on bit (WOB) among others.

Drag bits most often include PDC cutters mounted on blades of the bit that engage the surfaces of the borehole to fail the rock in the borehole. Each cutter is retained in a recess of the blade and secured by brazing, welding or other method. Drilling fluid is pumped down the drill string and through outlets or nozzles in the bit to flush the rock cuttings away from the bit and up the borehole annulus. While the invention is described in terms a drag bit, this is for the purpose of explanation and description. The invention is also applicable to core bits, reamers and other downhole cutting tools.

Some materials the bit advances through, such as shale, forms a sticky clay when the failed material absorbs water. Clays tend to cling to the surface of the channels of the bit, which results in narrowing the fluid passage through the channel and increasing channel pressure. The increased channel pressure together with expansion of the material as it absorbs water tends to promote more agglomeration of the clays which further bogs down the bit and decreases operation efficiency.

Described below are examples of bits that embody various improvements for improving evacuation of cuttings. In one embodiment, a drill bit includes a blade with a leading edge that supports an inner set of cutters along an inner leading edge portion of the blade, and an outer set of cutters along an outer leading edge portion of the blade that is rotationally offset from the first leading edge portion.

In another embodiment, a drill bit includes an inner channel, an inner nozzle at the inner end of the inner channel, an inner set of cutters behind the inner channel, an outer channel contiguous with the inner channel, an outer nozzle at the inner end of the outer channel, and an outer set of cutters behind the outer channel. The inner set of cutters are rotationally offset and forward of the outer cutters. The inner channel flushes material from the inner set of cutters and the outer channel flushes material from the outer set of cutters.

In another embodiment, a drill bit includes a bit face with an inner region proximate a longitudinal axis of the bit with one or more cutters and an outer region spaced from the longitudinal axis that includes one or more cutters. The inner region cutters are rotationally offset and forward from the outer region cutters.

In another embodiment, a drag bit comprises a body with a rotational axis including a forward blade and a rearward blade each upstanding from the bit body to define a front edge and a rear edge. Each of the blades extend radially outward from the longitudinal axis. The front edge of the rearward blade and the rear edge of the forward blade define a channel between the two blades. The rearward blade includes one or more inner cutters on an inner portion of the front edge, and one or more outer cutters on the outer portion of the front edge. The outer cutters are offset rearward from the first set of cutters to expand the channel so as to reduce the risk of clogging.

In another embodiment, cuttings are flushed from the face of a drill bit includes directing drilling fluid through a first nozzle forward of a first set of cutters along an inner leading edge of a blade and directing drilling fluid through a second nozzle rearward of the first set of cutters and forward of a second set of cutters on an outer leading edge of the blade.

In another embodiment, a drill bit includes a blade that supports an inner set of cutters generally along a first line or arc, and an outer set of cutters extending along a second line or arc rotationally and/or rearwardly offset from the first line.

In another embodiment, a channel portion and nozzle forward of an inner set of cutters works in tandem with a channel portion and nozzle forward of an outer set of cutters rotationally offset from the inner cutters. The channel portions are contiguous and each channel flushes material primarily from one set of cutters.

In another embodiment, the bit face includes an inner region about the longitudinal axis of the bit with one or more first cutters. The bit also includes an outer region spaced from the longitudinal axis and outside the inner region that includes one or more second cutters. The cutters of the inner region are rotationally offset from the cutters of the outer region.

In another embodiment, a core bit for collecting a core sample includes a bit body with an opening for the core sample, blades with a width and a thickness from the bit body extending from the opening around shoulders of the bit body, an inner cutter mounted on a leading edge of a first blade adjacent the opening to cut the core sample and a set of outer cutters spaced from the opening mounted to the leading edge of the first blade extending along a line away from the opening and rotationally offset from the inner cutter.

In some embodiments, the outer cutters are arranged generally along a line that is radially curved extending from the rotational axis or other location. In some embodiments of the invention, the bit has three blades each with an inner set of cutters and an outer set of cutters aligned along two lines offset from each other. In some embodiments of the invention, the bit has six or seven blades. In some embodiments of the invention, the blade with an inner set of cutters and an outer set of cutters has a thickness that is continuous without abrupt changes or gaps other than the offset between the inner and outer regions. In some embodiments of the invention, the blade with an inner set of cutters and an outer set of cutters extends from the axis of rotation and around a shoulder of the bit.

In one embodiment, a bit 10 includes a blade 12 with an inner portion 12A that supports one or more inner cutters 16 on the blade leading edge, and an outer portion 12B supporting one or more outer cutters 20 on the blade leading edge (FIGS. 2-11). The tables or forward faces of the inner cutters 16 are generally aligned with each other in a linear or curved arrangement. Likewise, the tables or forward faces of the outer cutters 20 are generally aligned with each other in a linear or curved arrangement. The outer cutters 20 are rearwardly and/or rotationally offset from the inner cutters 16. The alignment of the outer cutters 20 is not a continuation of the alignment of the inner cutters 16.

For purposes of this application, the inner cutters 16 and the outer cutters 20 are those primarily exposed on the downward facing surface of the bit (i.e., the nose and inner shoulder) and does not include those on the outer shoulder or gauge portions of the bit. Though these outer and gauge portions can have cutters that are aligned in the same way with the outer cutters 20 of this application, they need not be so for this application. Moreover, the inner and outer regions of the offset blades could have cutters that are not aligned and are not a part of the inner cutters 16 and outer cutters 20 on the leading edge of the blade. For example, cutters can be positioned on the face of the blade behind the leading edge of the blade. Preferably, the inner region includes inner cutters 16 generally aligned with each other on the blade leading edge and the outer region includes all outer cutters 20 along the leading edge generally aligned with each other.

Figure 2:
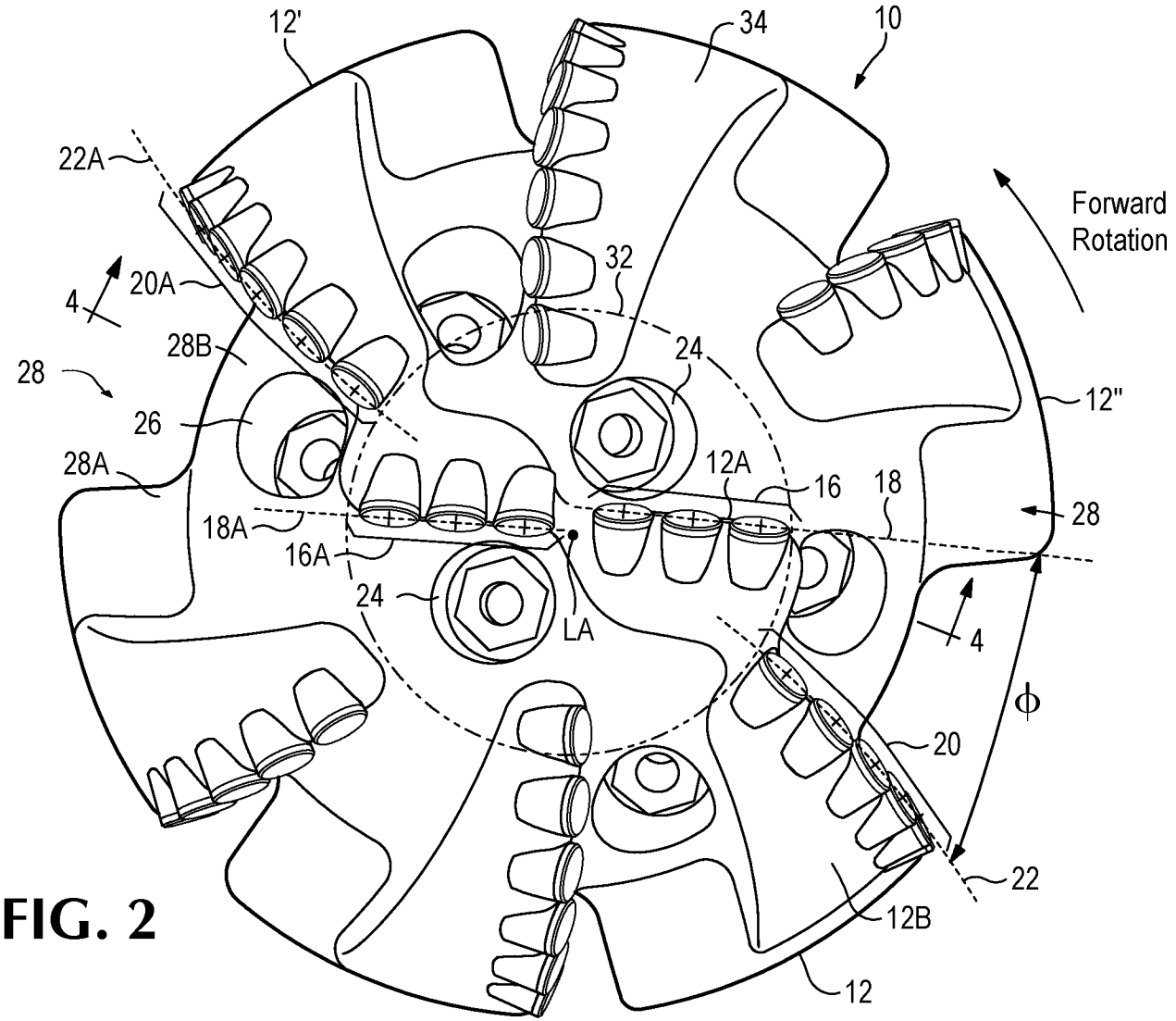
FIG. 2 is a front view of the inventive bit.

In the first illustrated embodiment, the forward faces of the tables (e.g., the diamond tables) on the inner cutters 16 are arranged in a linear manner along an inner line 18 (FIG. 2). Line 18 preferably extends outward and generally through the center of the faces of the aligned cutters, though some discrepancy in the alignment generally occurs through tolerances, manufacturing processes or by design. The outer cutters 20 are likewise arranged in general alignment along an outer line 22. Line 22 also preferably extends outward from the nose of the bit, and rotationally rearward of line 18. In this embodiment, lines 18, 22 are both generally linear but they could be curved.

The alignment of the cutters can be referenced by any consistent reference point of the cutters on the leading edge of the blade. The cutter reference point can be the center of the front face or the working edge of the front face extending farthest from the bit body. Other reference points can be used to define the lines. Cutter mounting methods can engender significant variation from the intended mounting position on the blade. The lines 18 and 22 can be defined by a best fit linear line or curve of the cutter reference points as viewed along the longitudinal axis LA of the bit. The general alignment of the inner and outer cutters for this application is radially outward as when viewing a plan view of the bottom of the bit. The cutters can also be arranged at different heights from the bit body such as seen in a vertical cross sectional view of the bit. The relative heights of the cutters may also be in alignment but they could be otherwise arranged.

The inner cutters 16 are rotationally offset from the outer cutters 20. As seen in FIG. 2, line 18 is at an angle Φ to line 22. In bit 10, the lines 18, 20 are generally linear and extend radially outward from the longitudinal axis LA. Angle Φ in a preferred embodiment is in an inclusive range of 5 to 45 degrees with the outer cutters rearward from the inner cutters, but the rotational offset angle is not limited to these values. Rotational offset angle Φ can include values greater or smaller than the range indicated. In one embodiment the angle is greater than 10 degrees. In a preferred embodiment the angle is greater than 20 degrees.

The inner and outer cutters 16, 20 could also be arranged along lines that do not intersect the longitudinal axis LA. The rotational offset angle could still be determined from the intersection of the two lines 18, 22. Additionally, the outer cutters 20 could be rearwardly spaced from the inner cutters 16 with an offset shoulder (existing or formed as a gap) even if a rotational measure is not relevant due to the positioning of the inner and outer blade portions. In a preferred construction, the forward faces of the outer cutters 20 are entirely rearward of the base portions of the inner cutters 16 though the offset could be less.

The offset blades are preferably continuous through the transition between the inner region and the outer region. Nevertheless, a gap could exist between the two regions so that the offset blade could be made up of an inner discrete blade segment and an outer discrete blade segment. These blade segments are intended to be relatively close to each other so they approximate the operation of the continuous offset blade. For discontinuous blades with discrete inner and outer blades the rotational offset angle is still preferably within the same ranges as a continuous offset blade. Such discrete blade segments are not substantially overlapping each other to be considered a single offset blade.

Offsetting of the inner and outer cutters allows better flushing of the cut material away from the inner cutters and outer cutters with limited intermixing. Intermixing in the channels can allow sticky materials such as clay to agglomerate or ball and clog the channels when stuck to the channel surface. By limiting the mixing in the channel and limiting pressure, balling of the clays is reduced.

Figure 3:
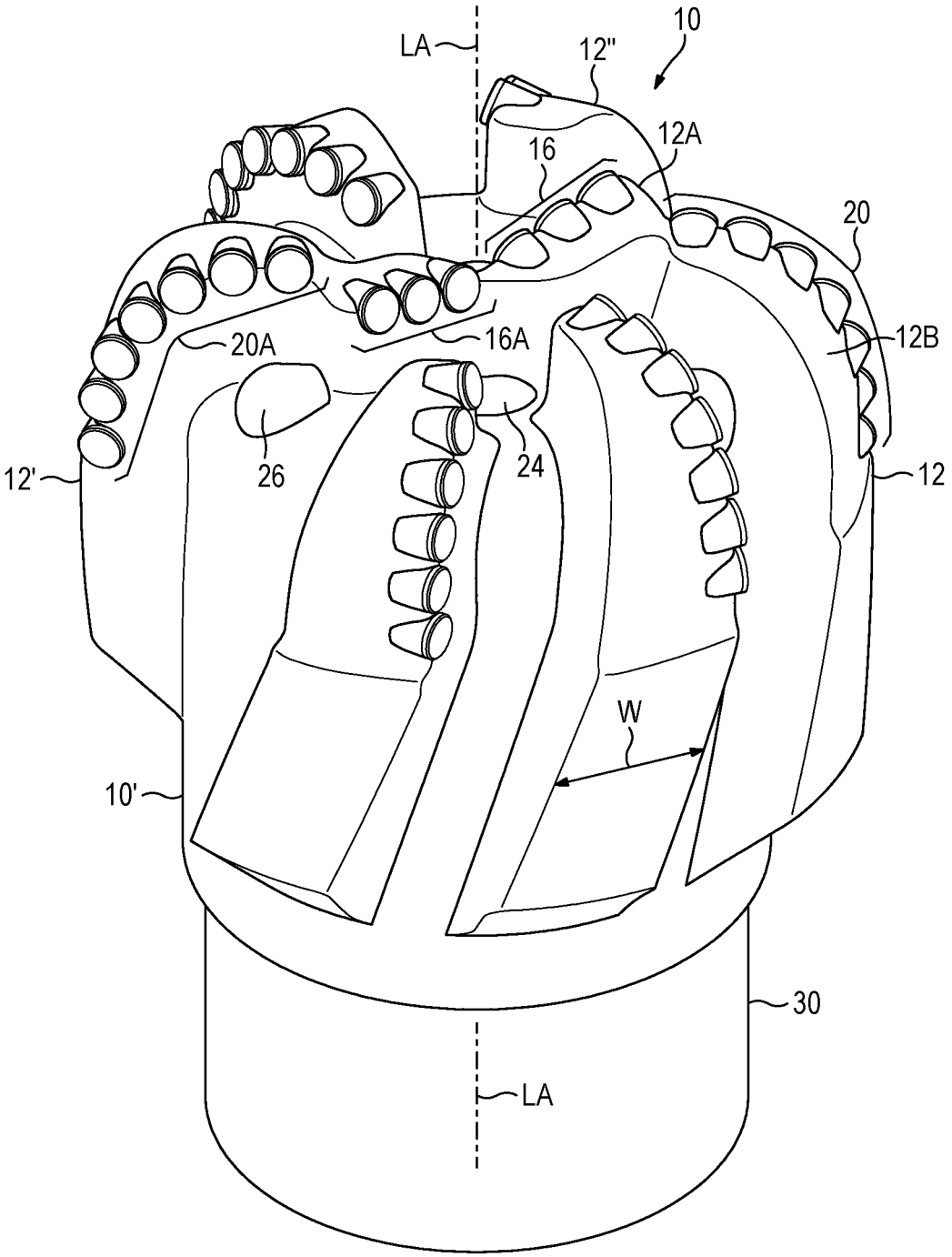
FIG. 3 is a side perspective view of the bit of FIG. 2.
Figure 4:
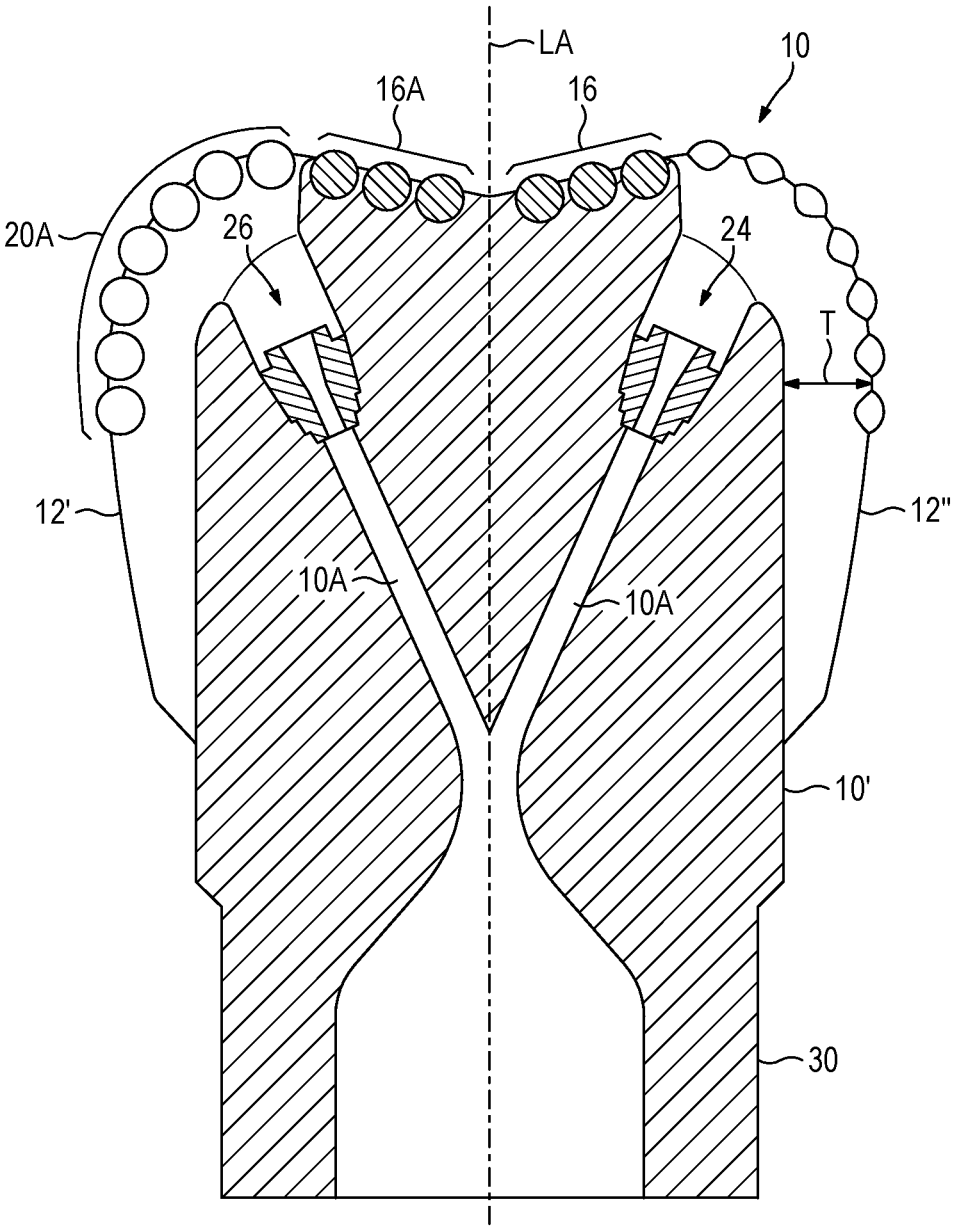
FIG. 4 is a partial cross section view of the inventive bit showing internal construction of the drill bit and the recess.

The blade has a thickness T from the bit body as shown in FIG. 4 and a width W as shown in FIG. 3. The blade may increase in radial thickness T above the bit body as the blade extends away from the longitudinal axis, but is preferably free of discontinuities in the thickness, i.e., the blade does not have significant gaps. In a preferred construction, blade 12 is continuous without holes or gaps. Nevertheless, blade 12 could be discontinuous and formed of a discrete inner blade and a discrete outer blade or formed with holes or gaps in the blade or at the offset shoulder between the inner and outer regions.

The blade can be oriented differently in the azimuthal direction (i.e., the forward and rearward direction in relation to bit rotation) extending away from the longitudinal axis. The rotational offset between the inner cutters and the outer cutters can coincide with an offset of the blade. The leading edge can jog transversely rearward to accommodate the rotational offset between the inner and outer cutters. This shift in the blade can increase the strength of the blade. Blade strength is generally measured as the amount of force required to fracture the blade applied to the leading edge of the blade rearward. At the jog of the blade, the material resisting the applied force on the blade may be doubled, increasing the strength of the whole blade significantly.

Inner region 32 can overlap the outer region 34 with cutters of the outer region following cutters of the inner region. For effective removal of clay materials, the overlap of leading edge cutters is limited to overlap of the outermost inner cutter and the innermost outer cutter.

The discontinuity or jog of the blade can be sharp and abrupt. Alternatively, the discontinuity can be a smooth transition. The bit of FIG. 2 includes conventional blades without rotationally offset inner and outer cutters combined with offset blades with offset cutters. In some cases blades extend only through an outer region 34 without extending inward to the longitudinal axis. The bit could also be formed entirely with offset blades.

In operation, bit 10 rotates so the cutters engage the borehole and fail the rock to advance the borehole. Bit 10 can include additional blades with offset cutters. The bit of FIG. 2 includes second blade 12' opposite blade 12. Blade 12' is similar to blade 12 and includes inner cutters 16A and outer cutters 20A with cutting faces aligned along lines 18A and 20A respectively. Lines 18A and 20A extend radially outward from the longitudinal axis.

In one embodiment, lines 18 and 18A are continuous without angular discontinuities so inner cutters 16 and 16A are similarly aligned. Lines 22 and 22A are also shown as continuous with outer cutters 20 and 20A similarly aligned. With similar alignments, the inner cutters are continuous through the longitudinal axis. Alternatively, bits may include inner cutters and outer cutters not continuously aligned through the longitudinal axis. The inner cutters may comprise one, two or more cutters. The outer cutters may comprise one, two or more cutters. The number of inner and outer cutters on one blade can be the same or different from the number of inner or outer cutters on another blade. Preferably as seen in FIG. 2, the division between inner and outer cutters is within the overall width of the bit body but variations are possible.

Bits 10 typically operate in a counterclockwise direction in the view of FIG. 2 with diamond tables of the cutter facing forward. Bit 10 may further include a third blade 12" forward of, and adjacent to blade 12. Blade 12 and blade 12" define a channel 28 between the blades. During operation, material of the borehole wall failed by cutters 16 and 20 is continually deposited in the channel and is flushed from the channel.

Bit body 10' includes a pin 30 spaced from the nose or face of the bit for attaching the bit to the drill string. Fluid conducted through the drill string passes through ducts 10A passing through the bit body (FIG. 4). The ducts open to the channels of the bit including channel 28 at nozzles 24 and 26. Fluid passing through the ducts and nozzles pass into the channels to flush the failed material from the channels and up the borehole around the drill string to the surface.

Bit 10 is shown with a nozzle 26 outward or at the outer end of inner cutters 16 in channel 28 forward of the outer cutters 20. A nozzle 24 is shown forward of inner cutters 16 in channel 28. The two nozzles and associated cutters of the channel function as dual channel portions. A first channel portion 28A is associated with nozzle 24 and cutters 16. A second channel portion 28B is associated with nozzle 26 and cutters 20. Although adjacent and contiguous, the first channel portion primarily flushes out debris cut by inner cutters 16 and the second channel portion primarily flushes out debris cut by outer cutters 20. The bit may include additional (or different) nozzles and ducts than those shown.

Channel 28 comprising the two channel portions generally diverges extending away from the nozzles. By diverging, the pressure in the channel is maintained at a low level in spite of material expansion. The depth of the channel can also increase extending form the nose region which serves to further decrease channel pressure. The channel depth can increase smoothly or in steps. First and second channel portions 28A and 28B can have different depths and different widths. Alternatively, first and second channel portions 28A and 28B can have similar depths and widths.

The volume of materials cut by the inner cutters and the outer cutters can be configured by the size, orientation or the number of cutters to feed proportional amounts of cut material to the two channel portions. The separate channel portions with separate fluid source nozzles flush the cut material more efficiently, removing the material before it can stick to channel surfaces. Faster removal of the cut material without increasing pressure limits the agglomeration of ribbons into a ball or mass that can occur with clays that develop from shale deposits as they absorb water. With a single line of cutters on a conventional blade more material interacts in the channel before it is flushed from the bit allowing it to ball in the channel and stick to surfaces. The inner cutters and the outer cutters are mounted on the leading edge of the blade adjacent the channel.

Bit 10 can include an inner region 32 proximate to the longitudinal axis LA that includes the inner cutters 16 and 16A. The outward extent of the inner cutters 16 and 16A can define the extent of inner region 32. In one preferred embodiment, the inner region includes cutters on the nose and shoulder of the bit. Outer region 34 is spaced from the longitudinal axis and outside of the inner region 32. Outer region 34 encompasses the outer or shoulder cutters 20 and 20A. Variations are possible. The inner region 32 could extend less far or farther from the longitudinal axis LA with an accompanying change to the outer region 34. The cutters within the inner region 32 are offset rotationally from the cutters of the outer region 34. The inner region can further encompass the nozzles forward of the inner cutters. The outer region 34 can encompass cutters on the nose and shoulder of the bit, and nozzles forward of the outer cutters.

Figure 5:
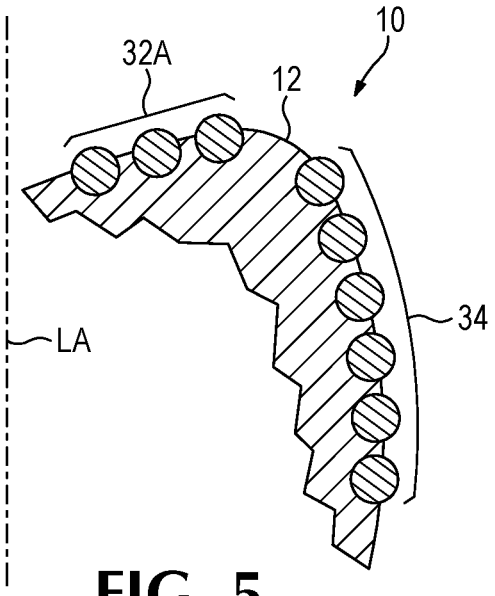
FIG. 5 is a cross section of a portion of a bit with a recessed cone inner region and an outer region.
Figure 6:
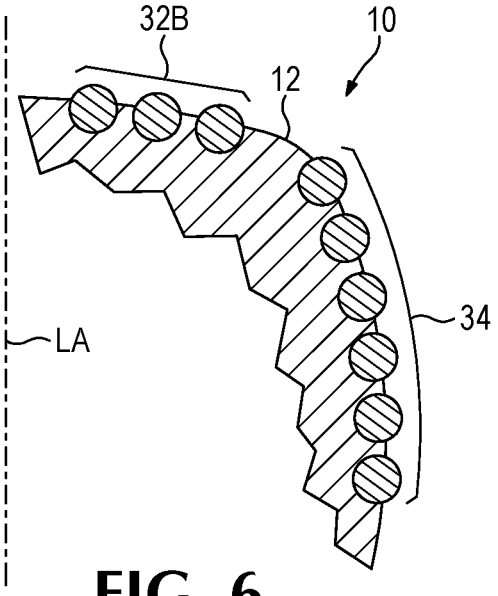
FIG. 6 is a cross section of a portion of a bit with a protruding inner region and an outer region.
Figure 7:
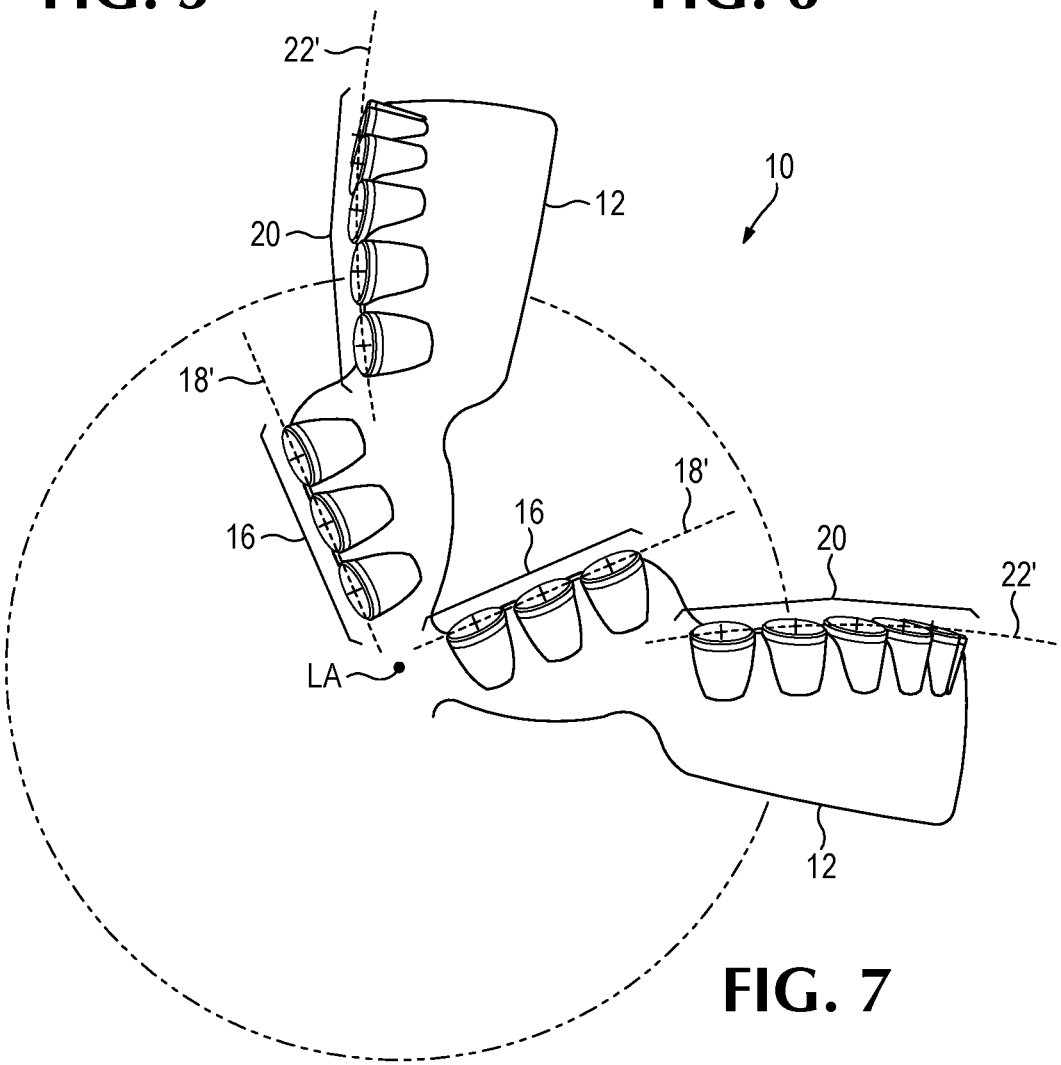
FIG. 7 is a front view of a portion of the bit.

The inner region 32A can be concave or recessed as shown in FIG. 5 so the cutters at the outer region advance the outer region of the borehole first. In some instances, this configuration can limit whirl of the bit in the borehole. Alternatively, as shown in FIG. 6, the inner region 32B can be flat or can protrude beyond the outer region. With the inner region protruding, cutters of the inner region advance the middle of the borehole before the outer region. Other variations in bit shape are also possible.

Lines defining the cutter alignment can extend as straight lines 18' and 22'. Alternatively, one or both lines can extend along a radial curve. The line 22" can curve generally, can curve about a radius of curvature or can follow an exponential curve. The inner and outer cutters are preferably aligned along lines that intersect the longitudinal axis LA whether the lines are linear or curved, but they could extend such they do not extend through the longitudinal axis.

Although FIG. 2 shows a bit with six blades and two sets of inner cutters, bits with other configurations and more or fewer blades, cutters and nozzles than shown are possible.

Figure 9:
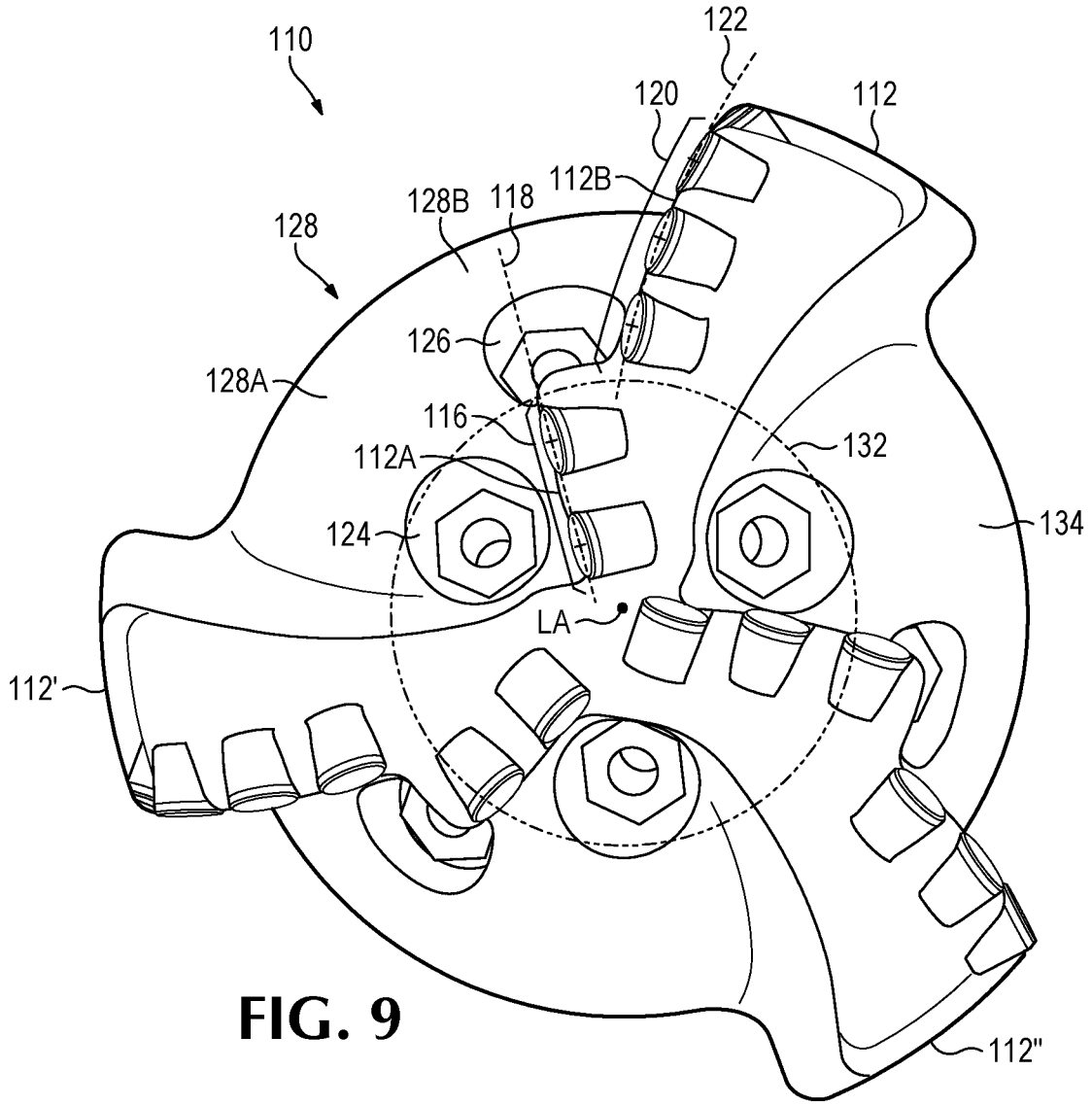
FIG. 9 is a front view of an alternative embodiment of the inventive bit.
Figure 10:
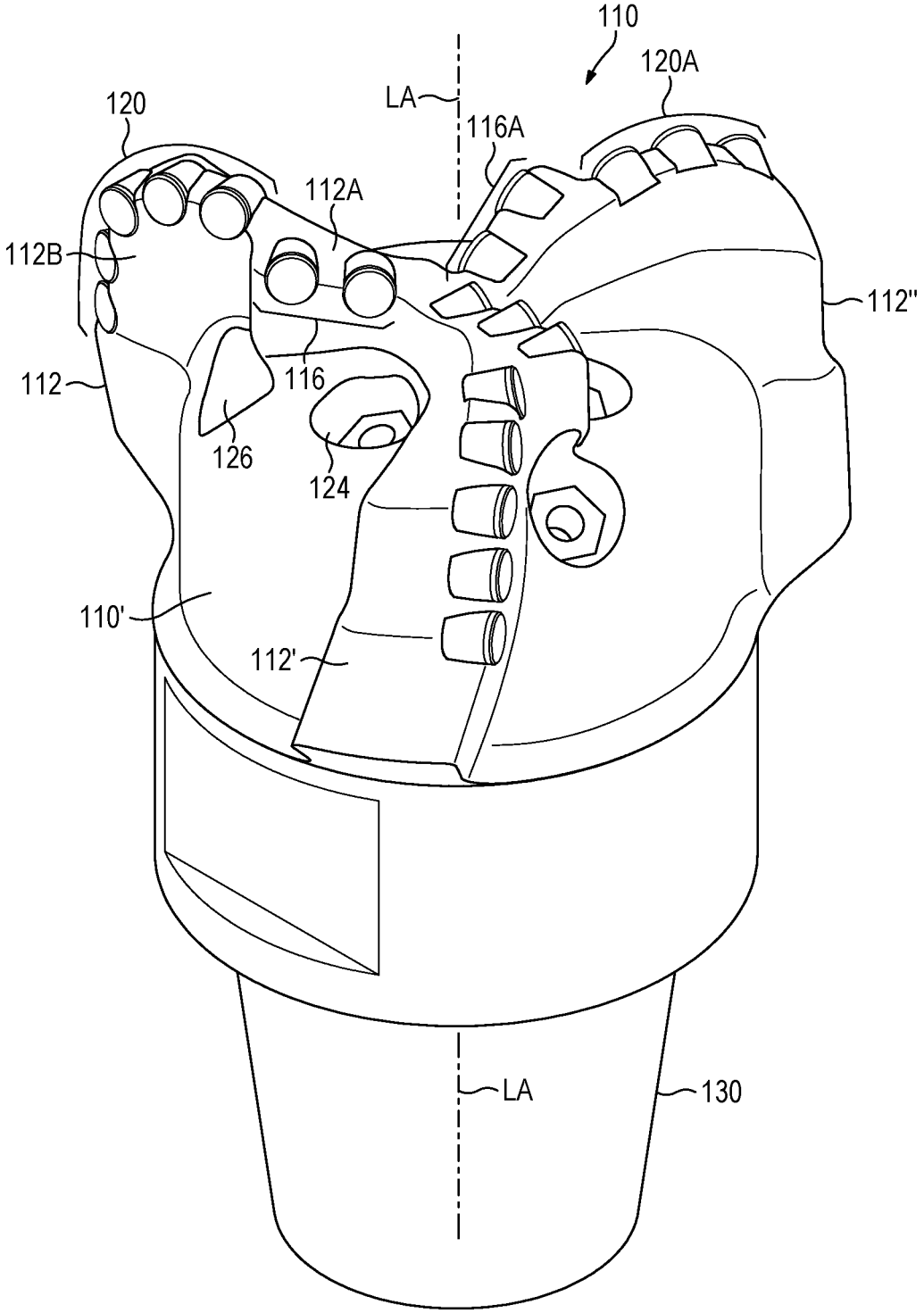
FIG. 10 is a front perspective view of the bit of FIG. 9.

FIGS. 9 and 10 show a front view and a side perspective view of a bit 110 with a blade 112, a second blade 112' and a third blade 112" each supporting cutters along a leading edge. Blade 112 includes an inner portion 112A with inner cutters 116 and an outer portion 112B with outer cutters 120. Second blade 112' forward of blade 112 defines a channel 128 between the two blades. A nozzle 126 outward of inner cutter set 116 and forward of outer cutter set 120 opens in channel 128. A second nozzle 124 opens in channel 128 forward of the outer cutters 120. Channel 128 may function as two channel portions 128A and 128B associated with nozzles 124 and 126 respectively.

Channel 128 functions in a similar manner to channel 28. Material cut by inner cutter set 116 is flushed by fluid from nozzle 124 through channel portion 128A. Material cut by outer cutters 120 is flushed by fluid from nozzle 126 through channel portion 128B. The parallel diverging channel portions reduce pressure in the channel and limit agglomeration of materials that when balled together can clog the channels.

Bit 110 has an inner region 132 about the longitudinal axis that encompasses and is defined by the extent of inner cutters 116. Outside of inner portion 132 outer region 134 includes outer cutters 120. The front faces of the inner cutters 116 are generally positioned extending along a linear line 118. The outer cutters 120 are generally aligned along a curved line 122. The inner and outer cutter alignments are rotationally offset from each other at an angle Φ.

Figure 8:
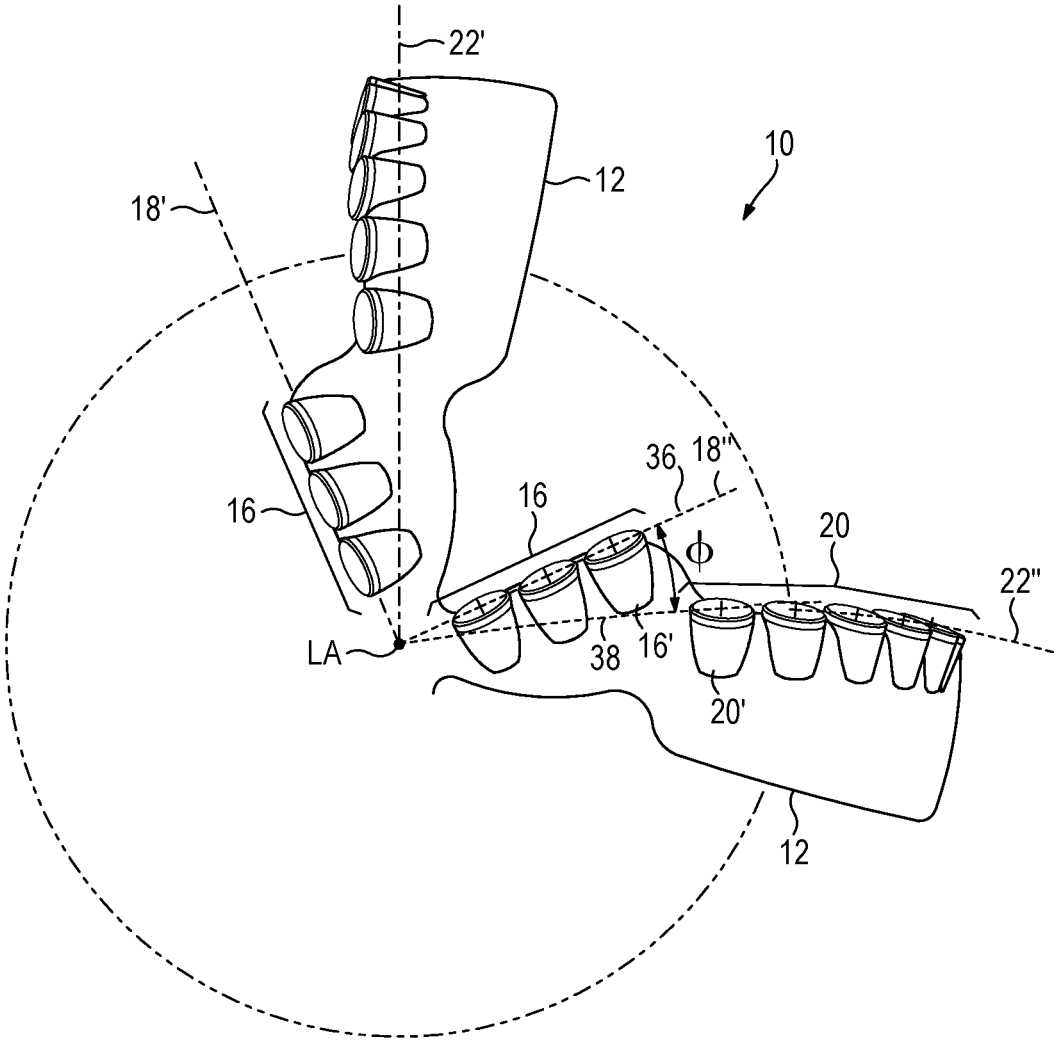
FIG. 8 is a front view of a portion of the bit.

As shown in FIG. 8, the rotational offset of the inner and outer cutters can be defined by the angle between lines 36 and 38. When one or more of the lines are curved, the rotational offset angle Φ is defined by the angle between an inner line 36 coincident with line 18' extending from the longitudinal axis LA and the forward face center point of the outermost inner cutter 16' and an outer line 38 extending from the axis LA to the forward face center point of the innermost outer cutter 20'. As noted above, in a preferred embodiment, the rotational offset of the inner and outer cutters is in an inclusive range of 5 to 45 degrees, but the rotational offset is not limited to these values. The rotational offset can include values greater or smaller than the range indicated. In one embodiment the offset angle is greater than 10 degrees. In a preferred embodiment the offset angle is greater than 20 degrees.

In an alternative embodiment the bit can be a core bit that advances the borehole as a ring around a core of strata. The core advances into a central opening in the bit and is collected for analysis. The core bit can include blades that extend from the opening around a shoulder of the bit supporting cutters on the leading edges. A first inner set of cutters are mounted on an inner region of the bit. One or more of the inner cutters are mounted adjacent the opening and function to shape the core sample as a cylinder. Some or all of the inner set of cutters can be plural set with overlap in the cutting profile and similar radial positions from the longitudinal axis of the bit.

Coring bits fail strata material over a smaller area about the core opening than a conventional bit in advancing the borehole. Additional cutters at the front edge of the bit and core opening can form a denser cutting profile. The working portion of a mounted cutter is the portion of the table extending furthest from the bit body that engages the borehole. Cutters set side to side on the leading edge of the blade are limited in their maximum density of cutter working portion engaging the borehole. By rotationally offsetting the inner cutters from the outer cutters, the cutters can overlap in the cutting profile. The innermost cutter of the outer cutters can be positioned behind the inner cutters with a limited radial offset from the forward cutter. This can provide a higher density of cutter working portion on the front of the bit. The forward cutters deposit cut material into the channel forward of the trailing outer cutters. This limits clogging of the outer cutters with cut material.

Figure 11:
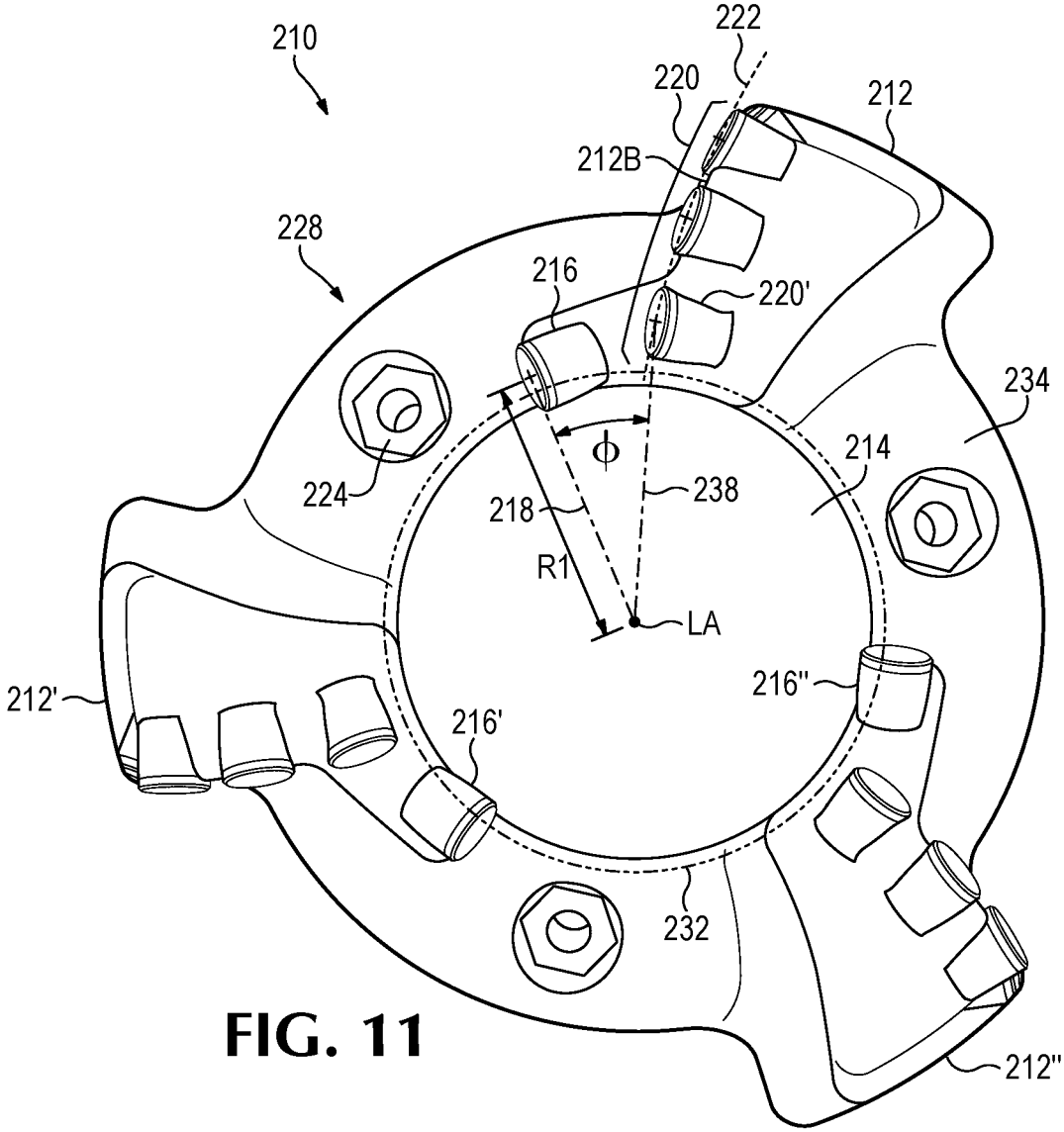
FIG. 11 is a front view of a core bit.

FIG. 11 shows a coring bit 210 with blades 212, 212' and 212". The bit includes an opening 214 for accepting a strata core for collection. Cutters 216, 216' and 216" are shown mounted on a leading edge of the blades at similar radial distances from the longitudinal axis in inner bit region 232, following each other as the bit rotates. These inner cutters cut the core sample about the circumference to form a cylinder. The inner cutters can extend into the circumference of the opening to cut core sample to a smaller diameter than the opening 214. The cutters in some embodiments can be ground to remove material on the side of the cutter to adjust the cutting distance of each inner cutter from the longitudinal axis.

Outer cutters 220 can be similarly mounted to the leading edge 212B of the blade 212 in an outer portion 234 spaced from the longitudinal axis. The outer cutters can be aligned along a straight or curved line 222. An innermost outer cutter 220' can be mounted to the blade behind inner cutter 216. The radial distance of the center of cutter 220' can be greater than the radial distance R1 of line 218 to the center of cutter 216 from the longitudinal axis and less than distance R1 plus the diameter of the cutter so the profile of cutters 216 and 220' overlap. This provides a more continuous cutter working portion at the front of the bit and greater cutting density about the opening 214.

The outer cutters on the outer portion 234 of the bit can be multiset, each cutter with a unique radial position. The outer cutters can extend along a curved or straight line extending from the nose or core opening of the bit. Similar to previous embodiments, the inner set of cutters is rotationally offset from the outer set of cutters. The inner cutters can be rotationally offset forward of the outer cutters or rearward of the outer cutters. Rearward offset of the inner cutters from the outer cutters can be useful for the noted purpose in the coring bit embodiment. This orientation is not an offset blade as discussed in the previous embodiments for reducing clogging.

The inner and outer cutters are preferably on the same continuous blade. The rotational offset between the inner cutters and the outer cutters can coincide with an offset of the blade. The leading edge can jog transversely rearward to accommodate the rotational offset between the inner and outer cutters. The blade with an inner set of cutters and an outer set of cutters has a thickness t without abrupt changes or gaps. Alternatively, the inner and outer cutters can be on discontinuous blades. The discontinuous blades can have limited overlap extending from the nose or core portion of the bit.

A nozzle 224 is shown forward of inner cutter 216 to flush material failed by the cutters through channel 228. Nozzles and associated cutters are shown as similarly configured on blades 212' and 212". Alternatively, a nozzle can be forward of the outer cutters and another nozzle forward of the inner cutters to optimally flush cut material.

The rotational offset can be defined by the angle between a line 218 to the face center of the outermost inner cutter 216 and line 238 extending from the longitudinal axis to the face centers of innermost outer cutter 220'.

Cutters can be mounted to the blades with side rake or back rake to facilitate cutting the core or strata of the borehole. Inner cutters can be mounted with positive back rake so the cutter face has a forward directional component along the longitudinal axis. This can reduce generation of long fractures or slabs when cutting material from the core sample. Inner cutters can be mounted with negative side rake so the cutter face has an outward directional component away from the longitudinal axis. This orientation of the cutter can direct cuttings toward the channel and into the fluid stream. Movement of cut material away from the core reduces interference between the core sample and the opening of the bit that can jam the core and limit movement into the opening. Other configurations and cutter orientations are possible.

In an alternative embodiment, the inner cutter can follow the innermost outer cutter 220' and overlap the cutting profile of the innermost outer cutter. In another alternative embodiment, a nozzle is positioned behind the outer cutters adjacent an inner cutter. In another alternative embodiment, the inner cutters can include two or more cutters mounted to the edge of the opening 214. The leading edge of the blade can extend to include a portion of the circumference of opening 214 proximate the blade so that two plural set inner cutters can be mounted to the leading edge 212B of the blade. The rotational offset is then determined from the inner cutter 216 closest innermost outer cutter 220'.

Figure 12:
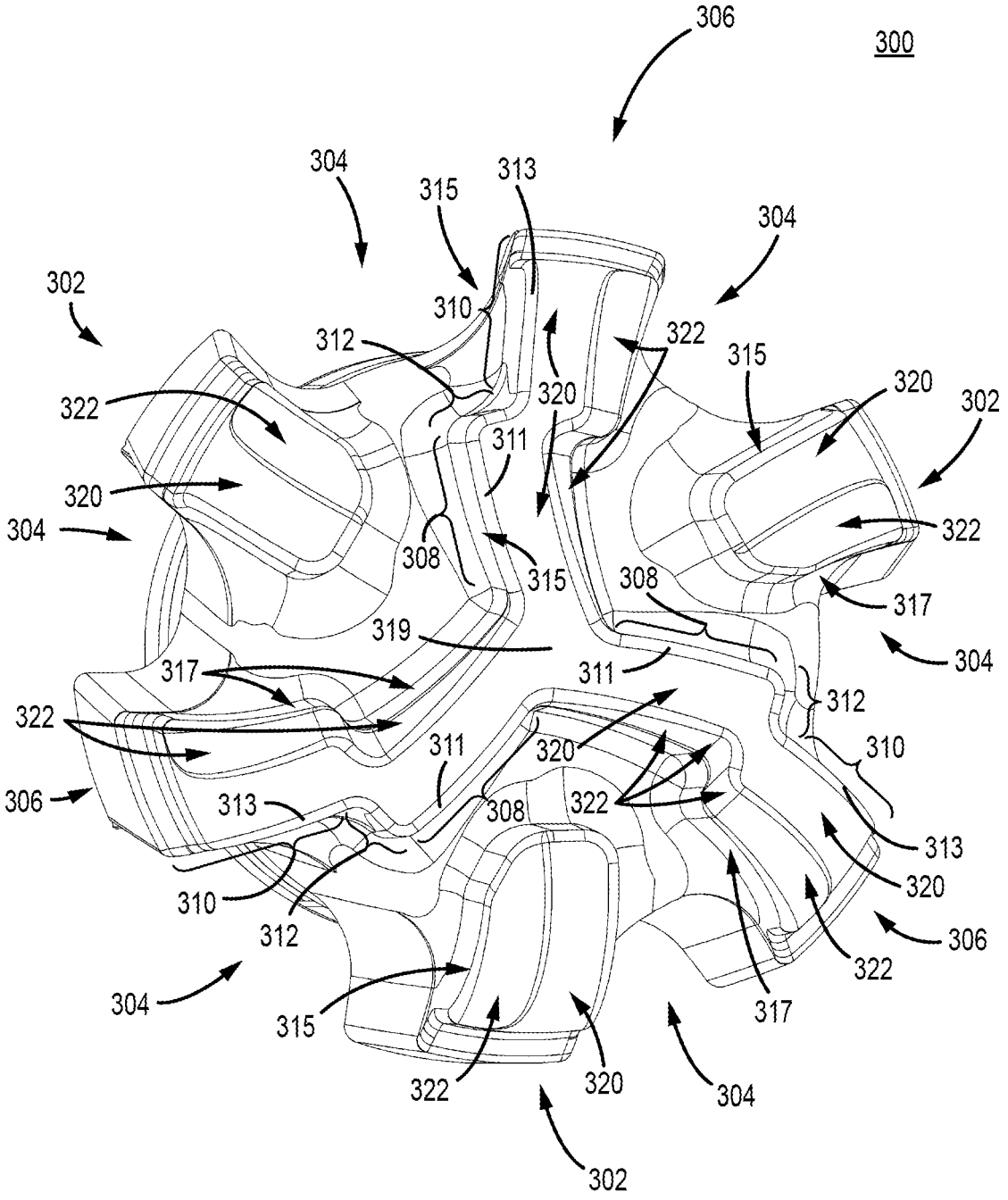
FIG. 12 is a schematic, top view of a representative PDC bit illustrated without cutters and pockets, showing just blade and channel geometries.
Figure 13A:
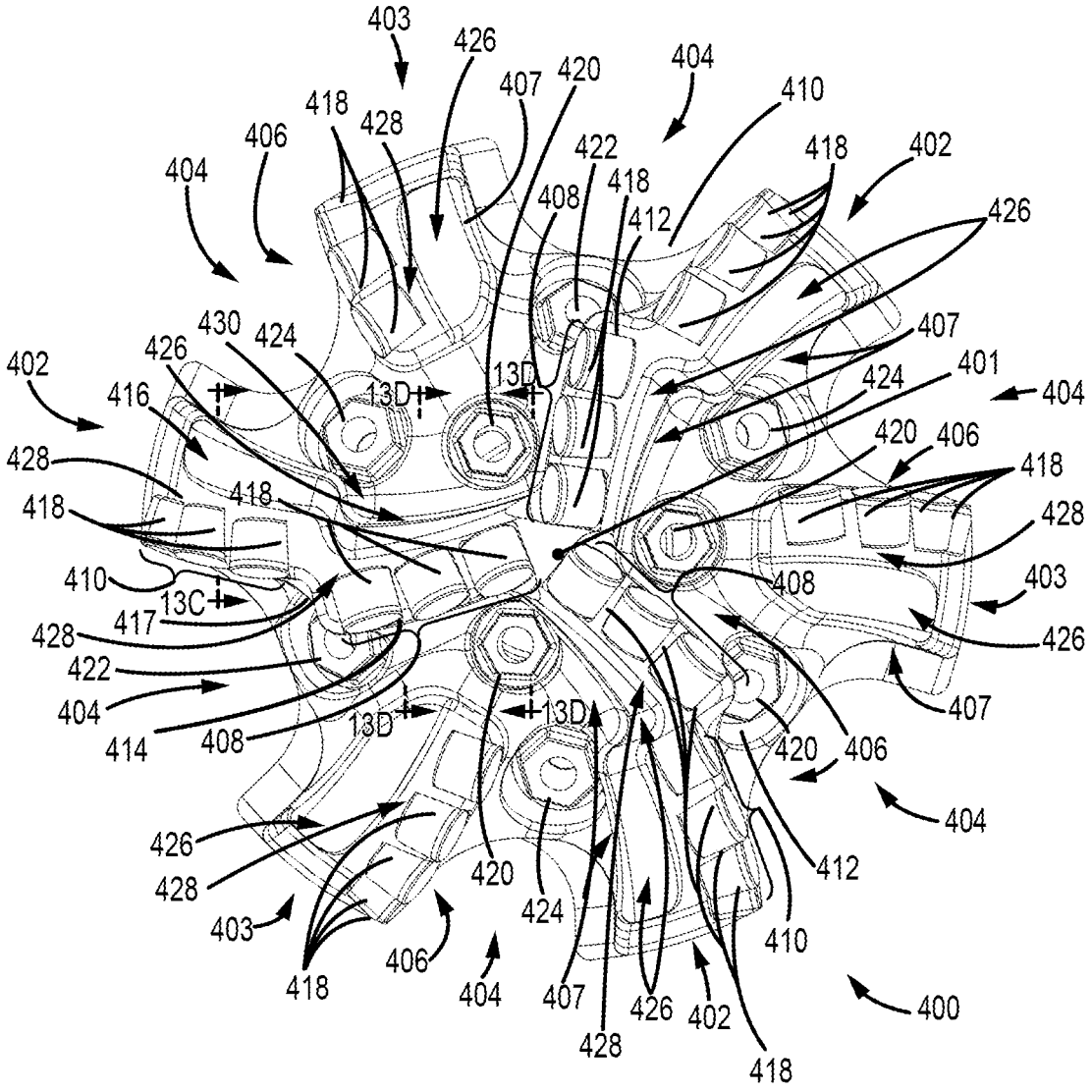
FIG. 13A is a top view of another, representative example of a PDC bit.
Figure 13B:
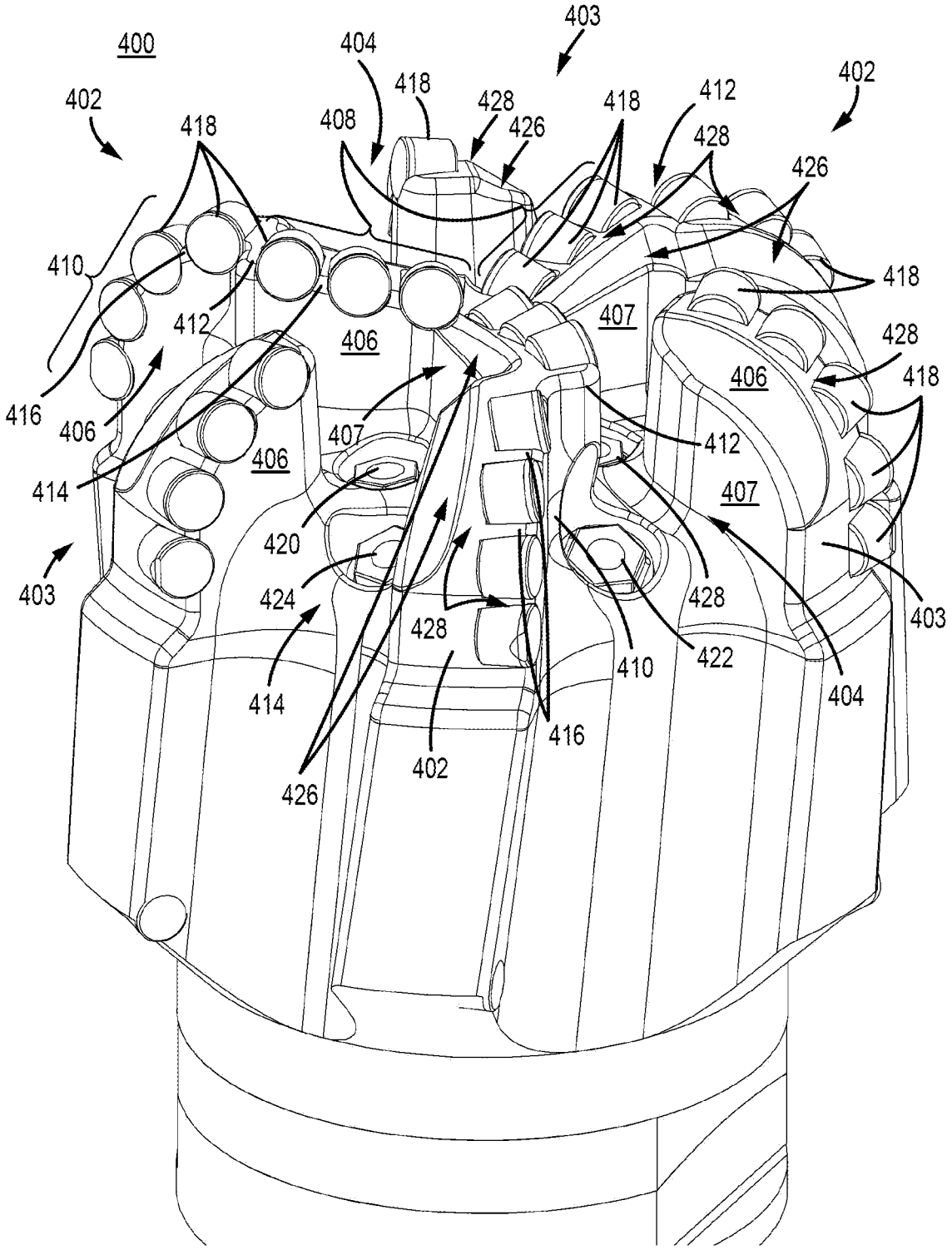
FIG. 13B is a perspective view of the PDC bit of FIG. 13A.
Figure 13C:
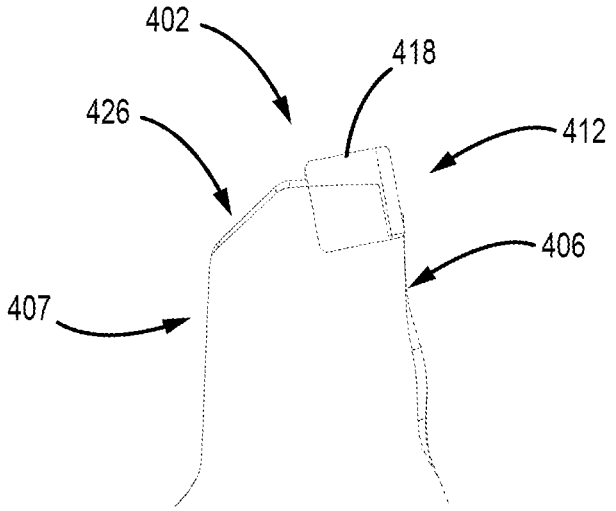
FIG. 13C is a cross section of one of the blades of the PDC bit of FIG. 13A.
Figure 13D:
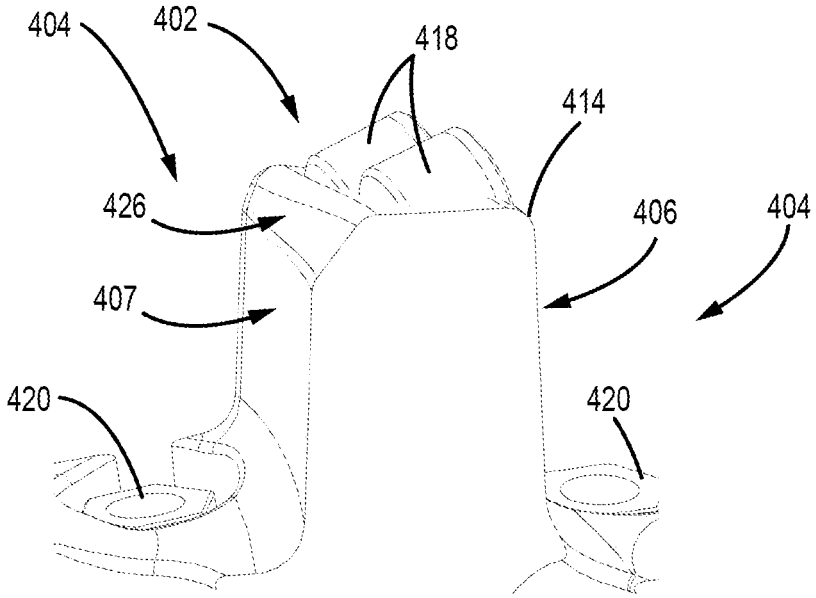
FIG. 13D is a cross section of one of the blades of the PDC bit of FIG. 13A. Will work with the perspective and that's great no prom guys know where this section was taken of that FIG. 14 is a top view of a representative example of an embodiment of a PDC bit.

FIG. 12 is a representative, non-limiting example of an embodiment of a body 300 of a PDC bit without cutters, pockets for the cutters, or nozzles that gives a different view of offset blade geometry. The body 300 is intended to be representative of bodies of wide variety matrix and steel-body PDC bits, including those that substitute for PDC cutters or other types of cutters made from super-hard, abrasion-resistant materials such as wurtzite boron nitride (WBN). The bit body 300 includes a plurality of blades 302 and 306 separated by channels 304 that extend along the face of the bit and then down the gauge for evacuating cuttings from the face of the bit. In this example, the plurality of blades includes primary blades 306, which are the blades that start at or near the bit's central axis and extend through the cone, nose, shoulder and gauge regions of the body, and secondary blades 302, which start in the nose region and extend through the shoulder and gauge regions. Each of the plurality of blades has a front side 315 adjacent to the channel 304 that is forward of the blade. The front side of the blade defines one side of the channel. A back side wall 317 of each of the blades defines a side of the channel 304 behind the blade. Each blade is separated from the blade in front of it and the blade behind it by a channel.

Each of the primary blades 306 in this example is an offset blade, meaning it has at least two blade portions, one of which is rotationally or angularly offset with respect to the centerline or axis of rotation 319 of the bit. In this example, each offset blade has a first blade portion 308 and second blade portion 310. The second blade portion is disposed radially outward (as measured from the axis of rotation 319) from the first blade portion 308. The first and second portions are also radially or rotationally offset, creating a step or offset along the front wall 315 of the blade. The first blade portion 308 may be referred to as an inner blade portion and the second blade portion 310 as an outer blade portion. The leading edge, where front wall of the blade transitions to the top surface of the blade, and along which the primary cutters are mounted), of a traditional blade is curvilinear. However, each offset blade is comprised of first leading edge portion 311 and second leading edge portion 313 that correspond to the first and second blade portions, respectively. Each leading edge portion is curvilinear as it extends outwardly from the center axis of the bit. However, there is a pronounced step or set back in the leading edge offset blade where it transitions from the first blade portion to the second blade portion. The distal end of the first leading edge portion is rotationally or angularly offset from the proximal end of the second leading edge portions, forming a step or offset such that the difference between the rotational or angular position of last cutter (most radially distant) on the first blade portion and the angular position of the first cutter on the second blade portion is much greater than the differences in angular positions of the last two cutters on the first blade section and the difference in the angular positions of the first two cutters on the second blade portion.

In the illustrated embodiment, the first blade portion 308 and the second blade portion 310 are attached or integrated; there is no break or opening in the offset blade 306 or separation between the portions. The two portions are connected by a segment of the blade that extends between a distal end of the first portion to a proximate end of the second portion, which will be referred to as a shoulder 312 (which is not to be confused with a shoulder section of the bit.) In alternative embodiments, one or more of the offset blades may have more than two offset portions.

The first blade portions generally extend from or near the axis of rotation 319. In this example, the first blade portion 308 of each offset blade lies within the cone region of the bit body and extends into the nose region of the PDC bit. However, in alternative embodiments, the first blade portions could lie only within the cone region, extend through the nose region, or extend into the shoulder region. The offset blade 306 adds, in effect, more lateral points of contact of the bit with the formation around the perimeter of the bit. The additional lateral points of contact allow for improved stability and directional tracking of the bit. The side the cutter surface of last cutter on the first blade portion will tend to be exposed also to the side of the formation.

The top surfaces 320 of each of the plurality of blades 302 and 306 of the blades can act as bearing surface that rubs against the formation when cutters penetrate the formation to the point at which the top of the blades 320 touch for the formation. The top surfaces of the blades can thus act to limit a depth of cutting. Generally, it is the front portion of the top surface of a blade that determines the exposure of at least the primary cutters that are mounted along the leading edge of the blade. The blade can act as bearing surface to limit depth of cut. However, when rates of penetration are high, the back of the top surface of a blade can rub against the formation before the primary cutters on that blade or other blades on the bit penetrate to the extent permitted by their exposure, thus slowing the rate of penetration to below what the bit might be otherwise capable of. Each of the plurality of blades 302 and 306 have an angled or sloping back blade surface 322 that start behind the cutters (not shown in this view) and extends to a top edge of the back wall 317 of the blades. The top edge is lower than the top surface of the blades at least where the sloped back blade surface exists. The sloped back blade surface forms an angled or sloped transition to the back side wall that, in effect, lowers or removes the part of the blades that would otherwise tend to hit against the formation during high rates of penetration. The angled or sloping surface shortens the width of the top of blade, but it avoids narrowing the base of the blade, which would tend to weaken the blade, and maintains a side wall that assists with directing the flow drilling fluid down the channel and helps to keep it from flowing up and over the blade.

Figure 14:
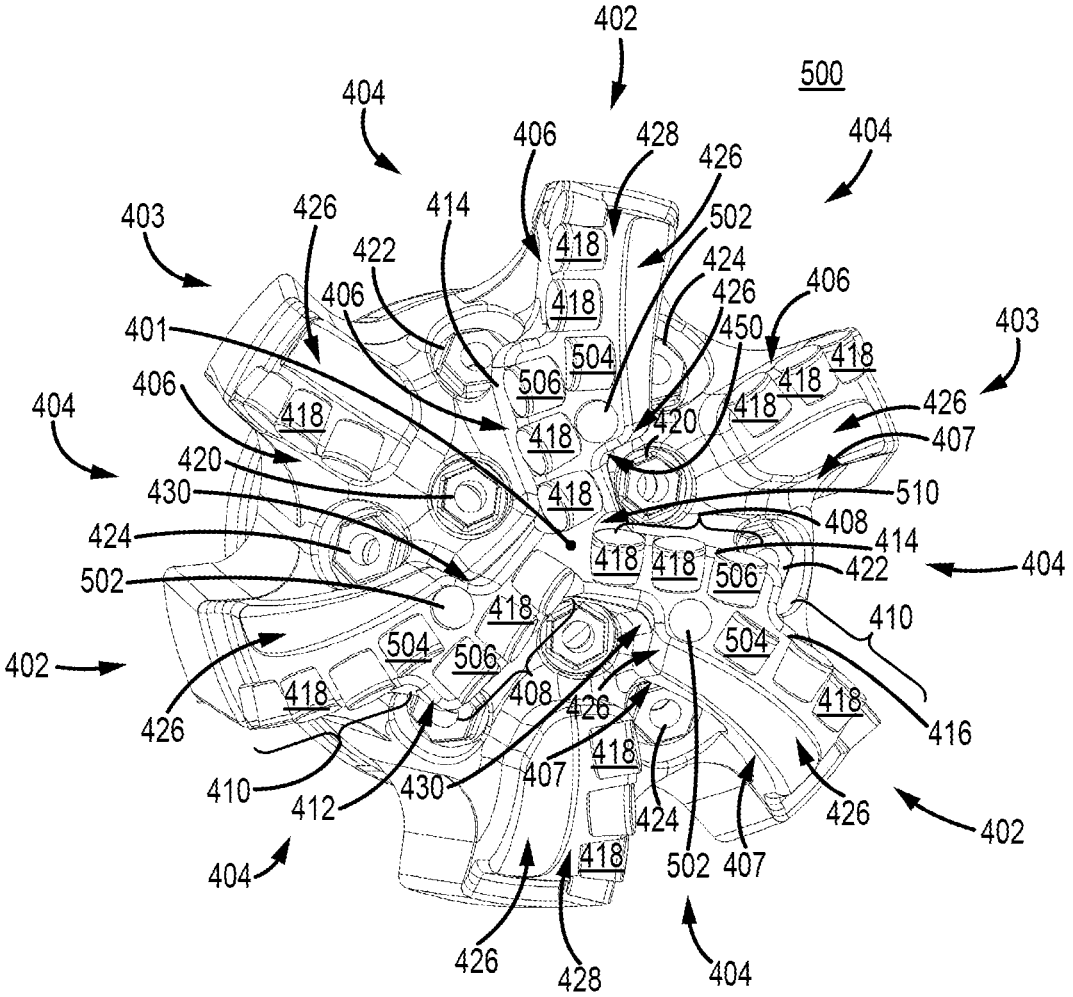
Figure 15:
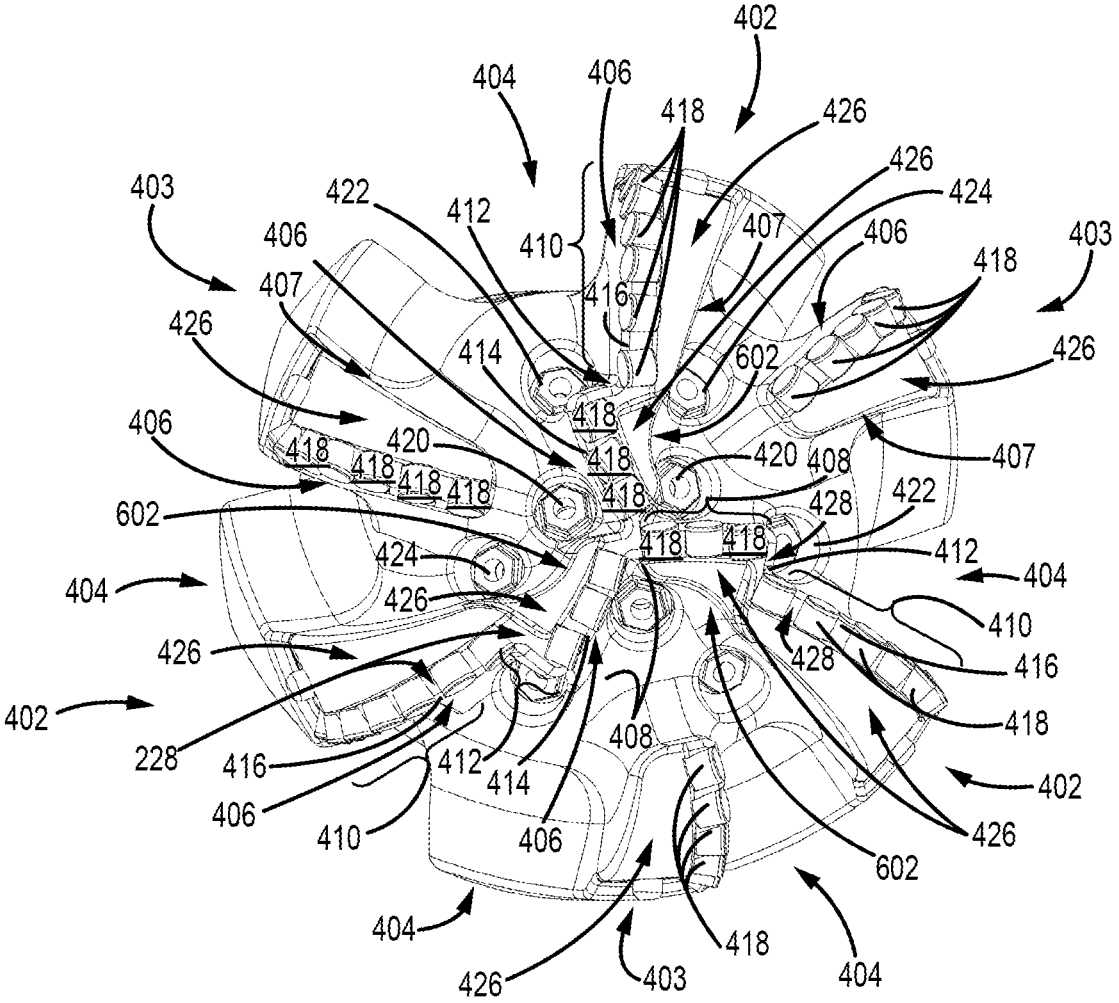
FIG. 15 is a top view of a representative example of an embodiment of a PDC bit.
Figure 16:
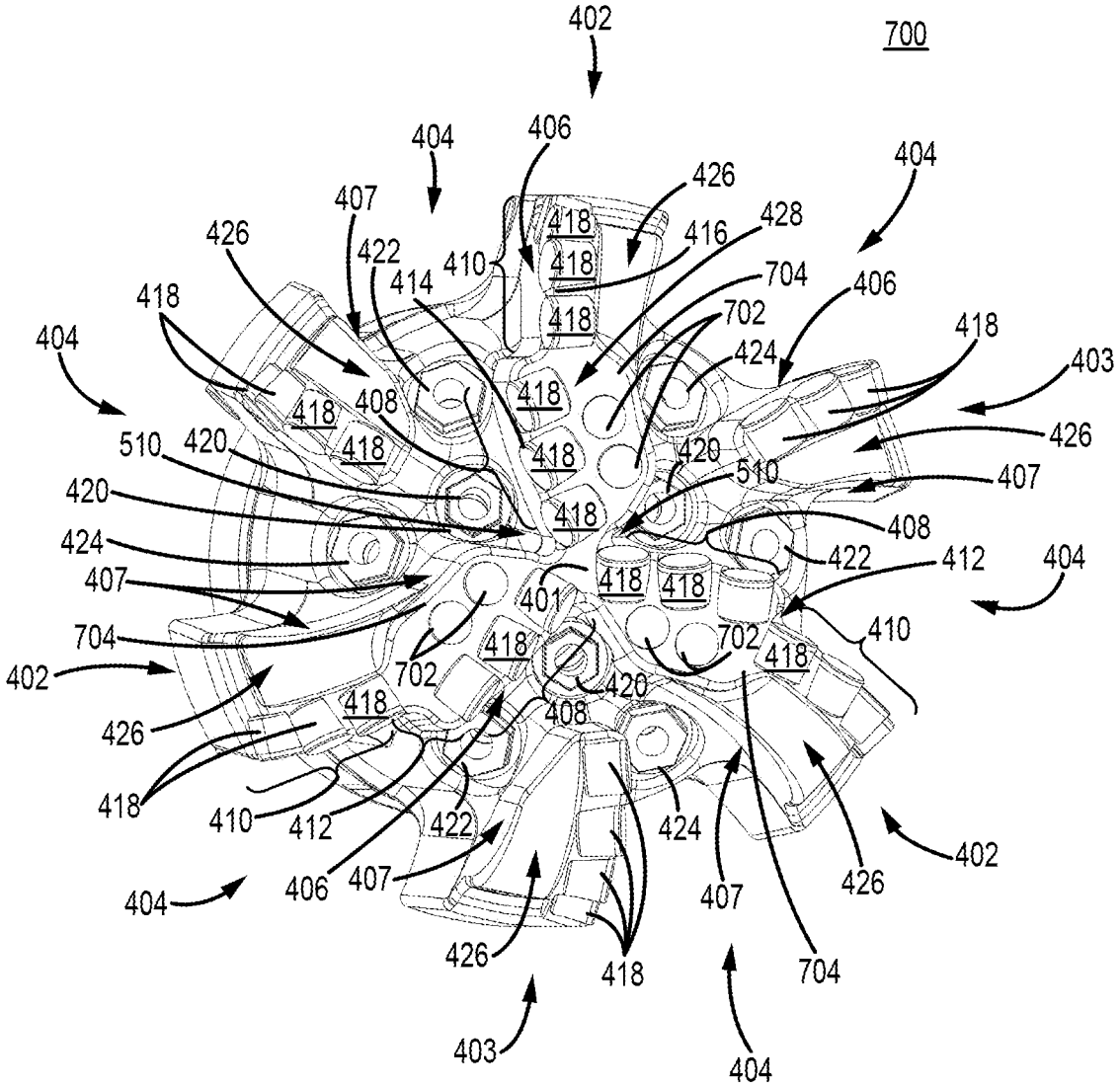
FIG. 16 is a top view of a representative example of an embodiment of a PDC bit.
Figure 17A:
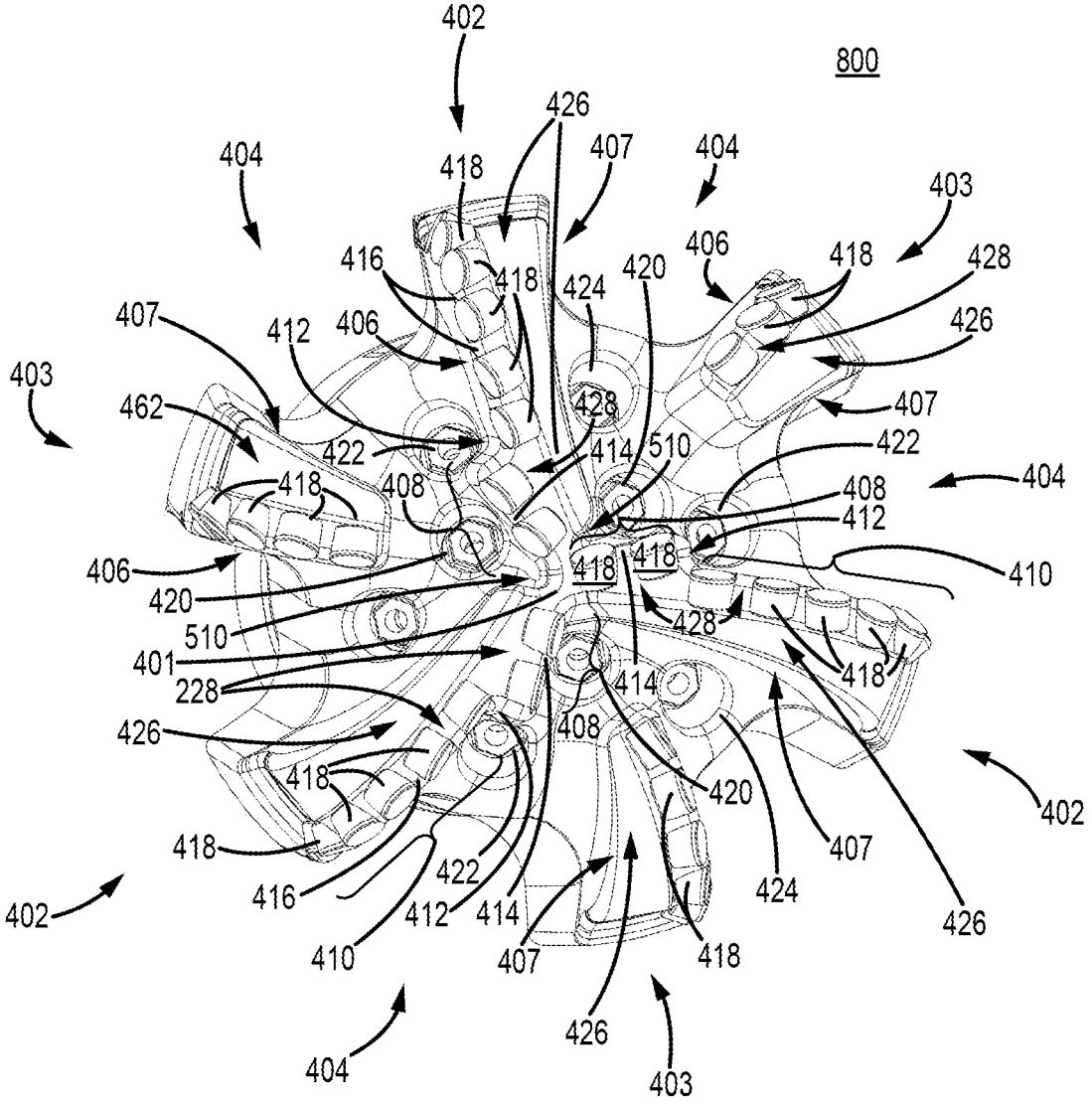
FIG. 17A is a top view a representative example of an embodiment of a PDC bit.
Figure 17B:
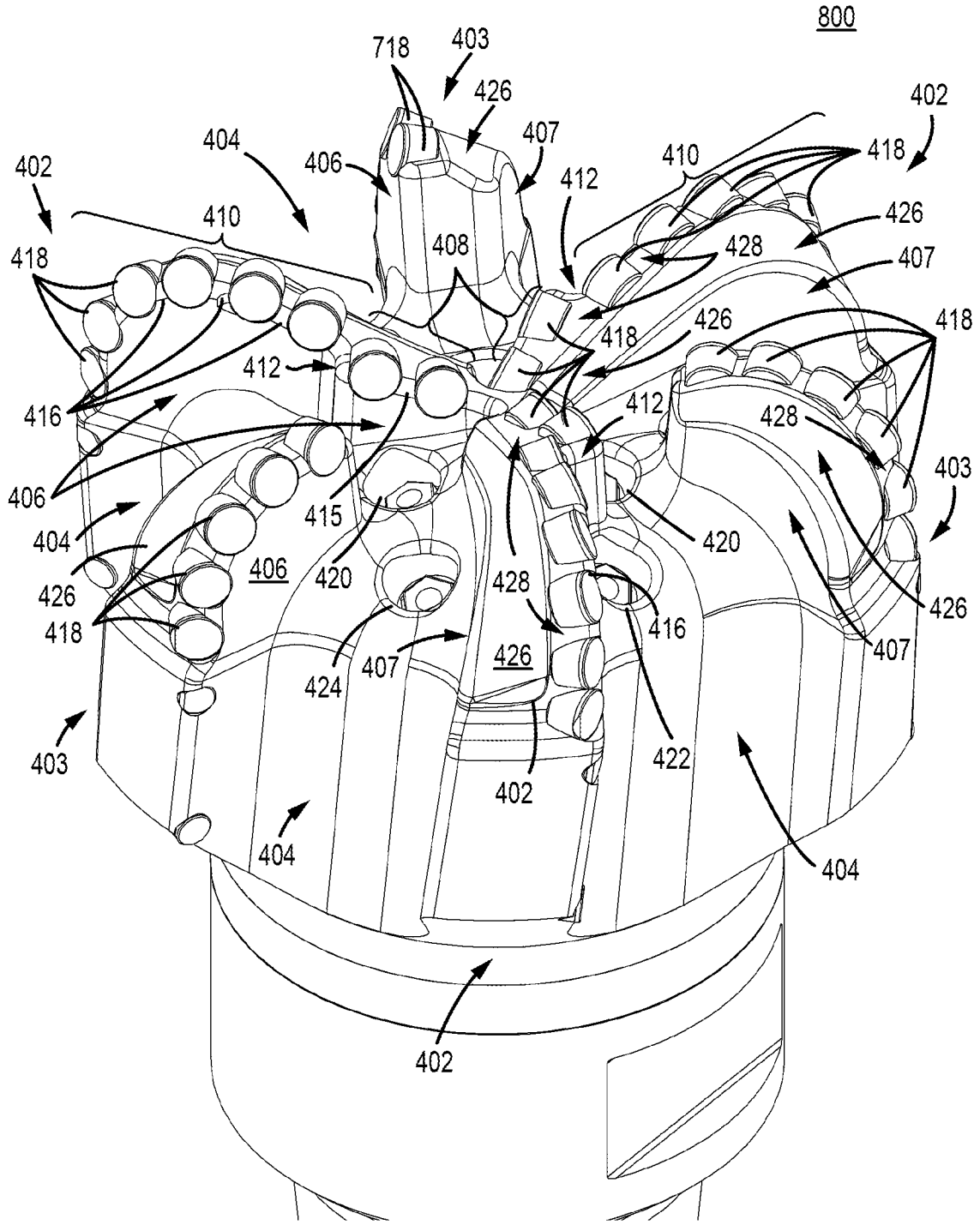
FIG. 17B is a perspective view of the representative example of an embodiment of a PDC bit of FIG. 17A.
Figure 18:
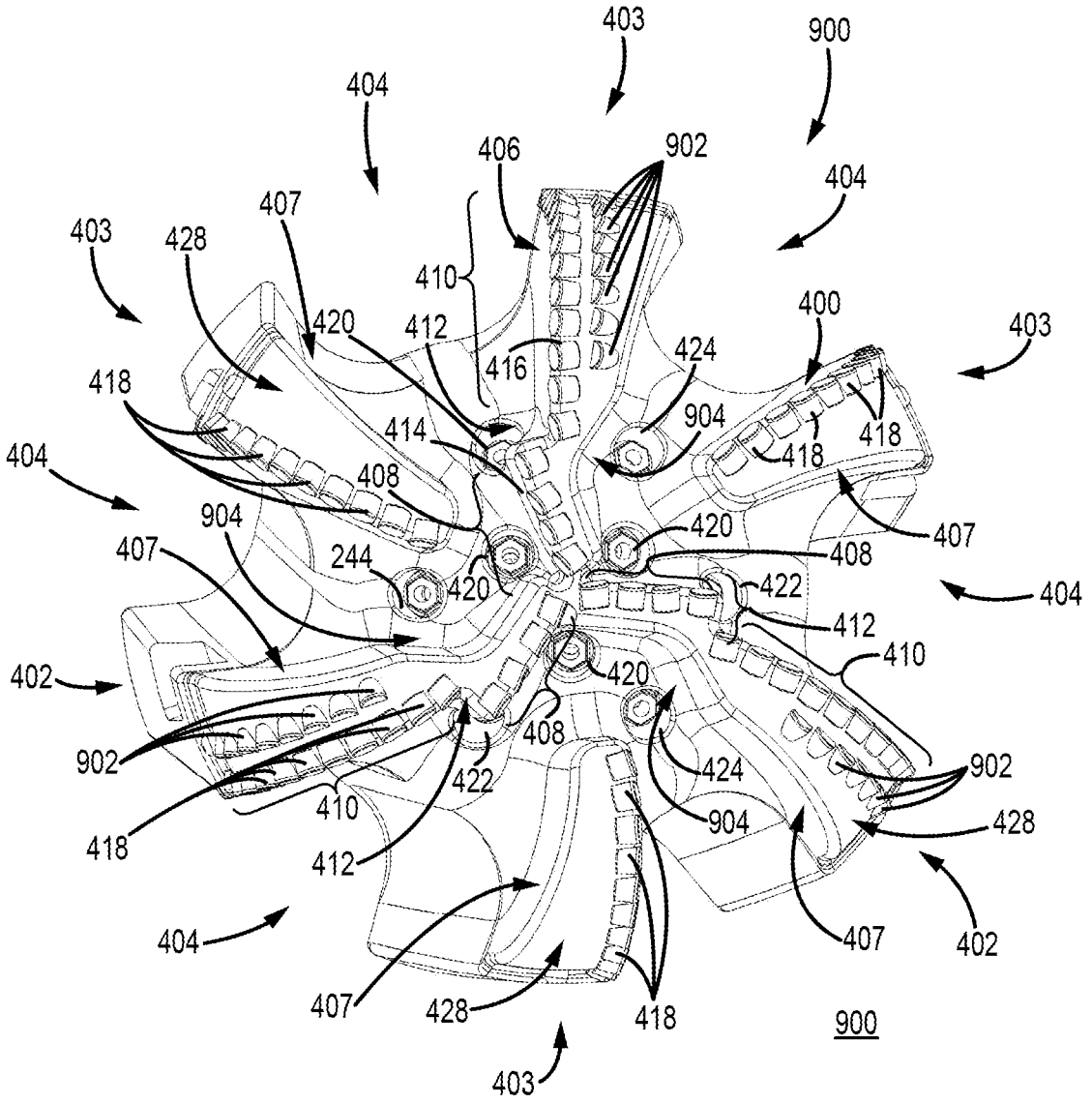
FIG. 18 is a top view of a representative example of an embodiment of a PDC bit.

Referring now to FIGS. 13-19, each of which illustrate a different example of a PDC bit: 400 in FIGS. 13A, 13B, 13C and 13D; 500 in FIG. 14; 600 in FIG. 15; 700 in FIG. 16; 800 in FIGS. 17A and 17B; and 900 in FIG. 18. The bits are representative, non-limiting examples of different embodiments of PDC bits employing offset blades. Because each example possesses similar (but not identical) features, these features will be described collectively using the same reference numbers for each of the examples. Differences will then be subsequently described.

The bodies of each of the bits 400, 500, 600, 700, 800, and 900 share a number of similarities with bit body 300 in FIG. 12. The profile of each bit is typical of PDC bits, but these examples are intended to be representative of drag bits with fixed cutters in general and more generally rotating downhole tools with fixed cutters for removing rock. The cross sectional profile of each bit includes a concaved, generally cone-shaped region around the center axis or axis of rotation 401, where the bit profile is angled with respect to the axis of rotation. The cutters on the cone typically perform most of the work of advancing of a bore hole. A nose region surrounds the cone and transitions the bit profile from the cone to the shoulder region. The cutters on the shoulder work primarily on widening the bore hole.

Each of the bits includes a plurality of blades 402 and 403 separated by channels 404. Each of the plurality of blades 402 and 403 has a front wall 406 and a back wall 407.

Each of the primary blades on each of the bits is an offset blade 402. Each bit also has secondary blades 403. Each offset blade 402 includes a first blade portion 408, second blade portion 410, and a shoulder portion 412 that connects the two at the point of offset. The second blade portion extends radially outward from a distal end of the first blade portion 408, with the proximal end of the second blade portion being angularly offset from the distal end of the first blade portion 408, with the shoulder portion 412 between. Each offset blade 402 thus forms a continuous or uninterrupted wall that defines the channels 404 on opposite sides of the blade, with no opening extending from the front wall 406 to the back wall 407 of blade and a well-defined corner on the front wall at the offset. The continuous, uninterrupted front and back walls construction has an advantage of allowing better control of drilling fluid through the channels and preventing drilling fluid from flowing between channels on opposite sides of the offset blade. Each offset blade 402 is, in these embodiments, integrally formed.

The first blade portion 408 of the offset blades 402 starts at or near the center of the bit, where it's axis of rotation is location, and extends through most if not the entire cone region of the bit profile. Depending on the embodiment, the first blade portion 408 terminates at a point within the cone, nose or shoulder region or at the transition between two of those regions. The second blade portion 410 starts where the first blade portion ends and continues to the bit's gauge.

The first blade portion 408 of each offset blade 402 includes a first leading edge portion 414 of the blade's leading edge. The second blade portion 410 of each offset blade 402 includes a second leading edge portion 416. The first and second leading edge portions comprise the leading edge of the blade. The leading edge of each of the offset blades therefore form a well-defined corner or step that generally follows the shape of the front wall 406 of the blade.

Primary cutters 418, which define a primary cutting profile for the bit and perform most of the work of failing rock to form the well bore, are placed along the leading edge of each blade. The cutters are, for example, polycrystalline diamond compact (PDC) cutters or equivalents. Other types of polycrystalline material are known substitutes for diamond. For purposes of this disclosure, references to PDC cutters also include cutters made from other polycrystalline materials, and PDC cutters are representative of fixed cutters. The cutters 418 on the second leading edge portion are part of the same bit cutting profile and blade primary cutting profile but are further rotationally offset than the cutters would be on a typical blade. The direction or vector of lateral forces generated from the cutters on the second blade portion is angularly displaced from those on the first blade portion, which will tend to increase lateral stability and steerability of the bit. The offset also exposes the side of last cutter of the first portion to the formation, creating an additional lateral point of contact and additional lateral force.

Each channel 404 has at least one nozzle. Channels in front of the offset blades have two nozzles, a first or upstream nozzle 420 and second or downstream nozzle 422. The downstream nozzle 422 is radially and angularly offset with the respect to nozzle 420. Nozzle 420 is placed near the beginning of the first blade portion 408 and oriented to direct drilling fluid generally toward the primary cutters 418 on the first blade portion 410, and then down the channel 404 that is in front of the offset blade. The offset of the second blade portion 410 from the first blade portion 408 creates an offset or step in the front and the leading edge of the offset blade 402 and accommodates the second nozzle 422 and allows it to be placed within the channel in position that reduces interference with the evacuation of cuttings from the cutters 418 on the first blade portion 408 while still allowing it to supply primary cutters on the second blade portion 410. The flow of drilling fluid from the upper nozzle can be oriented to flow within the channel, to the side of the downstream nozzle, while still supplying drilling fluid to the primary cutters on the first blade portion 408.

Nozzles 424 are oriented to create jets of drilling fluid toward cutters 418 on the secondary blades 403 and then down the channel 404 in front of each secondary blade.

Each of the blades in these examples include a sloped or angled back blade surfaces 426 along at least part of the blade that extends from a top surface 428 of each blade to at least a portion of the top edge of the back wall 407 that is lower than the top surface (lower than the profile of the bit). The back wall forms the back of each blade 402 and 403 and defines one side of the channel 404 that is to the rear of the blade. As described above, the top surfaces of the blades can act as a bearing surface that rubs against the formation when cutters penetrate the formation to the point at which the top of the blades 320 touch for the formation. However, when rates of penetration are high, the back of the top surface of a blade can rub against the formation before the primary cutters on that blade or other blades on the bit penetrate to the extent permitted by their exposure. Each of the plurality of blades 302 and 306 have a sloping surface 322, like a bevel, that starts behind the cutters (not shown in this view) and extends to the top of the back wall 317 of the blade, thus forming an angled or sloped transition between the top and back of the blade. The angled or sloping surface narrows the width of the top of blade without narrowing the base of the blade. Narrowing the width of the entire blade would weaken it. Sloping the back portion of the top of the blade, behind the cutters, in places where it would otherwise tend to hit the formation during full penetration of the primary cutters can help to improve the rate of penetration of the bit without significantly weakening the blade. However, in alternative embodiments, a step could be substituted for the slope if the strength provided by using a sloped surface is not required.

In several of the examples of bits shown in FIGS. 12-18, the sloped back blade surfaces 426 on the blades extend along at least a portion of the length of the blades in at least one of the cone, nose and shoulder areas. Where the sloped back blade surface extends most of the entire length of an offset blade, starting on the first blade portion 408 and extending along the second blade portion, it tends to be narrower in the cone region, where the blades are thinner, and grows wider as the blade grows thicker in the nose and shoulder areas.

However, in the examples of FIGS. 14 and 16, each of the first blade portions 408 does not have back sloping surfaces because of insert 502 on bit 500 (FIG. 14) and inserts 702 on bit 700 (FIG. 16). The inserts are used to control depth of cut. Also, in the example of FIG. 14 the second blade portion 410 of each offset blade extends partly behind the first blade portion 408 to allow the first cutter 504 on the second blade portion 410 to have a radial position in which the cutter's cutting profile partially overlaps the last cutter 506 on the first blade portion. The first cutter 504 and second cutter 506 are primary cutters like the other cutters 418 on the offset blade This partial overlapping of primary cutters in the primary cutting profile is generally only possible on a conventional blade by locating cutters on different blades. There are a limited number of blades within the cone area and, thus, places where cutters can be placed within the cone, and primary cutters must be spaced apart on blade in order to form pockets of sufficient strength to hold the primary cutters in position while drilling, as well as to accommodate primary cutters have large side rakes or large differences in side rake. The partial overlapping of the last cutter 506 and the first cutter 504 on the two portions of the offset blades allows for more primary cutters to be within the cone region and/or a closer spacing of the primary cutters that are adjacent in the primary cutting profile, while still allow the first cutter 504 access to the channel in front of the blade and drilling fluid for evacuation of cuttings. In an alternative embodiment, the first cutter 504 on the second blade portion 410 could be placed so that it overlaps the position of the last cutter 506 on the first blade portion 408. Plural set cutters—cutters that are in the same radial position and either on the same cutting profile or on a secondary cutting profile (a primary cutter and a backup cutter, for example)—are sometimes used. Usually they are backup cutters usually placed directly behind, in the same radial position, on the same blade as the primary cutter that they backup. Backup cutters have a lower exposure to the formation so that they engage or perform substantial work when the primary cutter wears down or is damaged. They also do not have direct access to the channel in front of the blade to receive the benefits of the drilling fluid for evacuating cuttings. Plural set primary cutters (meaning that they are part of the same cutting profile, with the same exposure to the formation) generally have to be placed on the leading edges different blades. However, the offset blade 402 allows, if desired, for plural set primary cutters on the same blade. The offset allows access to the channel in front of the blade so that cuttings from first cutter 504 on the second blade portion 410 can still be evacuated through the channel in front of the offset blade and receive drilling fluid from the second nozzle 422 that is placed in the corner of the front wall and leading edge of the blade formed by the offset.

In the example of FIGS. 13 and 14, the back wall 407 of each offset blade 402 on bits 400 and 500 has a corner 430 that forms a pocket-like area which creates a dead spot in which drilling fluid may not flow well, allowing cuttings to accumulate. This pocket can also be seen in the embodiment of FIG. 2. This is made worse when the cuttings are clay-like and form agglomerations.

However, the back wall 407 of each of the offset blades 402 of bit 600 (FIG. 15) has a curved portion 602 that, in effect, fills in the corner where the second blade portion offsets from the first blade portion, creating a smoother back wall where the offset is between the first and second blade portions 408 and 410. The smoother surface allows drilling fluid to push cuttings along the wall with less risk of them accumulating, as well as reduces the turbulence of the flow and the possibility of eddies forming. The sloped back blade surface 426 extends from the upper surface of the blade to the curved portion 602 of the back side wall.

In the example bit 700 of FIG. 16 the back wall of each of the offset blades 402 is made smooth by reason of the first blade portion 408 being made thicker by an extension 704 that provides a place to mount inserts 702 behind the cutters 418. The thicker first blade portion 408 effectively avoids creating a corner in the rear wall 407 at offset.

Turning to FIG. 17, bit 800 has offset blades 402 with relative short first blade sections 408 (with two cutters 418 each rather than three or more shown in the other examples) and a continuously curved back wall 407 that extends along both the first and second blade portions without a corner or step where the second blade portion is offset from the first blade portion. The sloped back blade surface 426 starts closely behind the cutters 418 on the second blade section 410 but further behind the cutters on the first blade portion 408, leaving a first blade section with a wider top surface 428 as compared to the top surface 428 on the second blade portion.

Referring to FIG. 18, the offset blades 402 of bit 900 have wider second blade portions 410 for mounting a row of back up cutter 902 immediately behind primary cutters 418 that are mounted along the second leading edge portion of the second blade portion 410. The backup cutters are on a secondary cutting profile and have a lower exposure than the cutters on the primary cutting profile. Furthermore, they are not mounted the leading edge of the offset blade and thus are not adjacent to a channel. Consequently, they do not benefit, at least to the same degree as the primary cutters 418, from proximity to high velocity drilling fluid jetting out of nozzles 420 and 422 for evacuating cuttings and cooling. The blades do not include sloped blade back surfaces; the backup cutters are intended to contact the formation once the primary cutters wear down or are damaged. The increasing thickness of the second blade portion allows for a smoother curved portion 904 (as opposed to an abrupt corner) on the back wall 407 where the blade is offset. The smoother, less abrupt transition in the back wall between the first blade portion 408 and the second blade portion 410 tends to reduce turbulence and improve drilling fluid flow efficiency and thus also cutter evacuation.

To facilitate drilling fluid reaching the first or inner-most cutter 418 on the first blade portion 408 of each offset blade a small notch 510 is formed on the back side 407 of each first blade section 410, where the three offset blades 402 meet in the middle of the bit, in bits 500, 600, 700, 800 and 900 to expose the inner must cutter to the flow of drilling fluid from nozzle 420.

Although bit examples with three and six blades are shown here as examples, different numbers of blades can be employed. Other examples of fixed cutter drag bits include those with one and two offset blades, as well as those with more than three, such bits including from zero to more than 3 secondary blades that are not offset. Although used to particular advantage of fixed cutters and rotary drag bits with similar body and blade geometries to those found on typical PDC bits, offset blades could be adapted to other types of downhole tools (PDC bits being one type of downhole tool) that advance, enlarge or shape wellbores, which employ fixed cutters arranged on blades separated by channels for evacuating cuttings, including those with body and cutting profiles different from PDC bits.

Furthermore, the accompanying figures described selected, representative examples of embodiments bits incorporating offset blade that are intended to be non-limiting. Variations of these examples within the ordinary skill of persons in the art are possible and are intended to be encompassed by the literal language appended claims. Furthermore, where the description and claims recite "a" or "a first" element or the equivalent thereof, such description includes one or more such elements, neither requiring nor excluding two or more such elements.

What is claimed is:

1. A downhole tool to be rotated for cutting rock to form a borehole comprising:

a body with a center axis about which the downhole tool rotates;

a plurality of blades comprising elongated raised areas on the body arrayed around the center axis, the plurality of blades defining a plurality of channels between the plurality of blades, each of the plurality of blades having a front wall partially defining one of the plurality of channels and a leading edge of the blade, and a back wall partially defining another one of the plurality of channels;

wherein each of the plurality of blades has arranged along of the leading edge of the blade a plurality of cutters in fixed positions on the blade; and wherein at least one of the plurality of blades is an offset blade, the offset blade comprising at least two portions, the at least two portions comprising a first blade portion and a second blade portion; the leading edge of the offset blade comprising a first leading edge portion and a second leading edge portion corresponding to the first and second blade portions, the second leading edge portion of the leading edge of the offset blade being angularly offset from the first leading edge portion in a circumferential direction such that the first leading edge is positioned rotationally forward of the second leading edge to form a step in the leading edge of the offset blade and the front wall without forming an opening in the offset blade extending between the front wall and rear wall of the offset blade, wherein the first leading edge is closer to the center axis than the second leading edge.

2. The downhole tool of claim 1, wherein, the offset blade comprises a top surface from which the plurality of cutters extend;

the back wall has a top edge that, along at least a portion of the back wall, is lower than the top surface; and the offset blade comprises a sloped back surface extending from the top surface to the lower portion of the top edge of the back wall.

3. The downhole tool of claim 1, wherein the back wall has a continuous curvature at a transition between the first blade portion and second blade portion.

4. The downhole tool of claim 3, wherein the back wall along the first blade portion aligns with the back wall along the second blade portion.

5. The downhole tool of claim 4, wherein the first blade portion has mounted behind the plurality of cutters on the first blade portion at least one depth of cut limiter.

6. The downhole tool of claim 4 the second blade portion has mounted behind the plurality of cutters mounted on the second leading edge portion a row of backup cutters.

7. The downhole tool of claim 3, wherein— the offset blade comprises a top surface from which the plurality of cutters extend;

the back wall has a top edge that, along at least a portion of the back wall, is lower than the top surface, and, the offset blade has a sloped back surface extending from the top surface to the lowered portion of the top edge of the back wall.

8. The downhole tool of claim 1, further comprising:

a first nozzle that is located within the channel adjacent the front wall of the offset blade and is positioned and oriented to direct a circulation medium toward the plurality of cutters on the first leading edge portion; and a second nozzle within the channel that is adjacent to the front wall of the offset blade, the second nozzle being located displaced angularly and radially from the first nozzle and oriented to direct the circulation medium toward the plurality of cutters on the second leading edge portion.

9. The downhole tool of claim 8, wherein the first nozzle is aimed away from the second nozzle to reduce mixing of circulation fluid from the first and second nozzles.

10. The downhole tool of claim 1, wherein tool is a rotary drag bit with a plurality of primary blades extending from the center axis, at least one of which is comprised of an offset blade.

11. A downhole tool to be rotated for cutting rock to form a borehole comprising:

a body having a cutting face and a center axis about which the downhole tool rotates;

a plurality of blades on the cutting face; a plurality of channels separating the plurality of blades, each of the plurality blades haying a front wail adjacent to one of the plurality of channels and a back wall adjacent to another of the plurality of channels;

wherein each of the plurality of blades has arranged along a leading edge of the blade a plurality of cutters in fixed positions;

wherein at least one of the plurality of blades is an offset blade, the offset blade comprising at least two portions, the at least two portions comprising a first blade portion and a second blade portion; the leading edge of the offset blade comprising a first leading edge portion and a second leading edge portion corresponding to the first and second blade portions, the second leading edge portion of the leading edge of the offset blade being angularly offset from the first leading edge portion in a circumferential direction such that the first leading edge is positioned rotationally forward of the second leading edge to form a step along the leading edge, wherein the first leading edge is closer to the center axis than the second leading edge; and wherein the downhole tool further comprises, a first nozzle that is located within the channel adjacent the front wall of the offset blade and is positioned and oriented to direct a circulation medium toward the plurality of cutters on the first leading edge portion; and a second nozzle within the channel that is adjacent to the front wall of the offset blade, the second nozzle being located displaced angularly and radially from the first nozzle and oriented to direct the circulation medium toward the plurality of cutters on the second leading edge portion.

12. The downhole tool of claim 11, wherein the first nozzle is aimed away from the second nozzle to reduce mixing of circulation fluid from the first and second nozzles.

13. The downhole tool of claim 11, wherein the plurality of cutters along the leading edge of the offset blade each occupies a position in a primary cutting profile of the downhole tool, and wherein a first one of the plurality of cutters on the second leading edge portion has a cutting profile that at least partially overlaps a cutting profile of an outermost one of the plurality of cutters on the first leading edge portion.

14. The downhole tool of claim 11, wherein— the offset blade comprises a top surface from which the plurality of cutters extend;

the back wall has a top edge that, along at least a portion of the back wall, is lower than the top surface; and, the offset blade further comprises a sloped back surface extending from the top surface to the lower portion of the top edge of the back wall.

15. The downhole tool of claim 11, wherein the offset blade comprises a back wall has a continuous curvature from the first blade portion to the second blade portion.

16. The downhole tool of claim 11, wherein— the offset blade has a top surface from which the plurality of cutters extend;

the back wall has a top edge that, along a portion of the back wall along where the first blade portion transitions to the second blade portion, is lower than the top surface; and the offset blade further comprises a sloped back surface extending from the top surface to the lower top edge portion of the back wall.

17. A rotary drag bit for cutting rock to advance borehole comprising:

a body having a cutting face and a center axis about which the bit rotates, the cutting face having a cone region, a nose region, and shoulder region and a gauge;

a plurality of elongated blades on the cutting face extending radially outwardly, at least one of the plurality of elongated blades being a primary blade extending from nearing the center axis;

a plurality of channels separating the plurality of elongated blades, each of the plurality of elongated blades haying a front wall adjacent to one of the plurality of channels and a back wall adjacent to another of the plurality of channels; and a plurality of primary cutters mounted in fixed positions along a leading edge of each the plurality of elongated blades, the plurality of primary cutters defining primary cutting profile for the bit, each of cutters having a radial position with the primary cutting profile, a radial position on one of the plurality of elongated blades, and an orientation;

wherein the primary blade is an offset blade, the offset blade comprising at least two portions, the at least two portions comprising a first blade portion and a second blade portion; the leading edge of the offset blade comprising a first leading edge portion and a second leading edge portion corresponding to the first and second blade portions of the offset blade, the second leading edge portion of the leading edge of the offset blade being angularly, offset from the first leading edge portion in a circumferential direction such that the first leading edge is positioned rotationally forward of the second leading edge to form a step without forming an opening in the offset blade extending between the front wall and rear wall of the offset blade, wherein the first leading edge is closer to the center axis than the second leading edge;

wherein the offset blade further comprises a top surface from which the plurality of primary cutters extend, the back wall has a top edge that, along at least a portion of the front wall, is lower than the top surface, and, the offset blade comprises a sloped back surface extending from the top surface to the lower top edge portion of the back wall.

18. The rotary drag bit of claim 17, wherein the back wall has a continuous curvature where the first blade portion transitions to the second blade portion.

19. The rotary drag bit of claim 17, wherein the back wall along the first blade portion aligns with the back wall of the second blade portion.

20. The rotary drag bit of claim 19, wherein the first blade portion has mounted behind the plurality of primary cutters on the first blade portion at least one depth of cut limiter.

21. The rotary drag bit of claim 19 the second blade portion has mounted behind the plurality of primary cutters mounted on the second leading edge portion a row of backup cutters.

22. The rotary drag bit of claim 17, further comprising:

a first nozzle that is located within the channel adjacent the front wall of the offset blade and is positioned and oriented to direct a circulation medium toward the plurality of primary cutters on the first leading edge portion; and a second nozzle within the channel that is adjacent to the front wall of the offset blade, the second nozzle being located displaced angularly and radially from the first nozzle and oriented to direct the circulation medium toward the plurality of primary cutters on the second leading edge portion.

23. The rotary drag bit of claim 17, wherein a first one of the plurality of primary cutters on the second leading edge portion has a cutting profile that at least partially overlaps a cutting profile of an outermost one of the plurality of primary cutters on the first leading edge portion.

* * * * *